US010563397B2

(12) United States Patent
Van Cauter et al.

(10) Patent No.: US 10,563,397 B2
(45) Date of Patent: Feb. 18, 2020

(54) STRUCTURAL BLOCK WITH INCREASED INSULATION PROPERTIES

(71) Applicant: Universiteit Gent, Ghent (BE)

(72) Inventors: Leo Van Cauter, Ghent (BE); Patrick Ampe, Ostend (BE); Veerle Boel, Herdersem-Aalst (BE)

(73) Assignee: UNIVERSITEIT GENT, Ghent (BE)

( * ) Notice: Subject to any disclaimer, the term of this patent is extended or adjusted under 35 U.S.C. 154(b) by 0 days.

(21) Appl. No.: 15/764,945

(22) PCT Filed: Oct. 3, 2016

(86) PCT No.: PCT/EP2016/073578
§ 371 (c)(1),
(2) Date: Mar. 30, 2018

(87) PCT Pub. No.: WO2017/055630
PCT Pub. Date: Apr. 6, 2017

(65) Prior Publication Data

US 2018/0298608 A1 Oct. 18, 2018

(30) Foreign Application Priority Data

Oct. 1, 2015 (EP) ..... 15188011

(51) Int. Cl.
*E04C 1/00* (2006.01)
*E04B 2/26* (2006.01)
*E04C 1/41* (2006.01)

(52) U.S. Cl.
CPC . *E04B 2/26* (2013.01); *E04C 1/41* (2013.01)

(58) Field of Classification Search
CPC . E04C 1/397; E04C 1/41; E04C 2/288; E04B 2/14; E04B 2002/0293; E04B 2/52; E04B 1/7608; E04B 2/26
See application file for complete search history.

(56) References Cited

U.S. PATENT DOCUMENTS 3,885,363 A * 5/1975 Whittey ..... E04B 1/8404 52/125.3
4,002,002 A * 1/1977 Barnhardt, Jr. ..... B28B 11/042 264/175
4,058,948 A * 11/1977 Warren ..... E04C 1/41 52/323

(Continued)

FOREIGN PATENT DOCUMENTS

DE 3011764 A1 10/1981
EP 0209993 A2 1/1987

(Continued)

*Primary Examiner* — Gisele D Ford
(74) *Attorney, Agent, or Firm* — James Creighton Wray

(57) ABSTRACT

An improved insulating block that offers great structural strength by having an interconnected block material structure with cavities filled with insulating material. The paths from the front face to the back face of the block through the block material are adapted to ensure an improved thermal insulation of the block, while providing a high load bearing capacity and allowing continuation of longitudinal reinforcement. This results in a block that can be easily manipulated and handled. Furthermore, the invention provides a method of manufacturing and a use of said blocks, and a wall or structure of said blocks.

19 Claims, 7 Drawing Sheets

(56) References Cited

U.S. PATENT DOCUMENTS 4,071,989 A * 2/1978 Warren ..... E04C 1/41 181/285
4,073,111 A * 2/1978 Warren ..... E04C 1/41 52/407.1
4,123,881 A * 11/1978 Muse ..... E04B 2/44 52/100
4,148,166 A * 4/1979 Toone ..... E04B 2/44 52/270
4,185,434 A * 1/1980 Jones ..... E04C 1/41 52/405.1
4,193,241 A * 3/1980 Jensen ..... E04C 1/41 52/125.3
4,269,013 A * 5/1981 West ..... E04B 2/48 52/405.1
4,348,845 A * 9/1982 Iannarelli ..... E04C 1/41 52/309.9
4,380,887 A * 4/1983 Lee ..... B28B 7/162 52/405.1
4,462,195 A * 7/1984 Nickerson ..... E04C 1/41 52/309.4
4,498,266 A * 2/1985 Perreton ..... E04C 1/41 52/405.4
4,527,373 A * 7/1985 Cruise ..... B28B 11/042 52/405.1
4,551,959 A * 11/1985 Schmid ..... E04C 1/41 52/309.12
4,584,043 A * 4/1986 Riefler ..... B28B 11/00 156/297
4,614,071 A * 9/1986 Sams ..... E04C 1/41 52/309.12
4,670,204 A * 6/1987 Cruise ..... B28B 11/042 264/333
4,694,624 A * 9/1987 Juhas ..... E04C 1/397 52/223.7
4,745,720 A * 5/1988 Taylor ..... E04C 1/41 52/405.1
4,748,782 A * 6/1988 Johnson ..... E04B 2/06 52/220.2
4,802,318 A * 2/1989 Snitovski ..... E04C 1/41 52/309.11
4,854,097 A * 8/1989 Haener ..... E04C 1/41 52/309.11
4,856,248 A * 8/1989 Larson ..... E04C 1/41 52/405.1
4,887,405 A * 12/1989 Nickerson ..... E04C 1/41 52/309.12
4,986,049 A * 1/1991 Kennedy ..... E04C 1/41 52/309.12
5,062,244 A * 11/1991 Ducharme ..... E04C 1/41 52/309.12
5,066,440 A * 11/1991 Kennedy ..... B28B 19/003 264/246
5,209,037 A * 5/1993 Kennedy ..... B28B 19/003 52/309.12
5,349,798 A * 9/1994 Gross ..... E04C 1/40 52/309.12
5,822,939 A * 10/1998 Haener ..... E04C 1/41 52/405.2
5,904,963 A 5/1999 Blatter
6,205,726 B1 * 3/2001 Hoadley ..... E04B 2/16 52/309.12
6,453,625 B1 * 9/2002 Corbett ..... E04C 1/41 52/125.3
9,822,529 B1 * 11/2017 Al-Salloum ..... E04C 1/41
2001/0022057 A1 9/2001 Miller
2006/0101756 A1 * 5/2006 McClure ..... E04C 1/41 52/405.1
2008/0060300 A1 * 3/2008 Westmoreland ..... E04B 2/52 52/405.4
2008/0104916 A1 * 5/2008 Schmid ..... B28B 1/002 52/405.2
2008/0184650 A1 8/2008 Fischer
2008/0236081 A1 * 10/2008 Kennedy ..... E04C 1/41 52/405.1
2011/0308188 A1 * 12/2011 Jorgensen ..... E04C 1/41 52/596
2014/0150361 A1 * 6/2014 Castonguay ..... E04B 2/26 52/309.4
2014/0260029 A1 * 9/2014 Browning ..... E04C 1/41 52/309.4
2016/0145864 A1 * 5/2016 Al-Salloum ..... E04B 2/18 52/600

FOREIGN PATENT DOCUMENTS

EP 2598706 A2 6/2013
WO 2009013289 A2 1/2009

* cited by examiner

STRUCTURAL BLOCK WITH INCREASED INSULATION PROPERTIES

TECHNICAL FIELD

The invention pertains to the technical field of building block used in building constructions such as houses, buildings and other structures. More precisely, the invention relates to thermally insulating concrete blocks for building these constructions, and even more specifically blocks to be used as bearing element for constructions having multiple storeys, in situations where thermal bridges might be present and higher requirements are to be met regarding stability (strength of the block and continuity of longitudinal reinforcement throughout the block).

BACKGROUND

There is a variety of hollow (concrete) building blocks known, some of which with insulating material in the cavities within. The cavities disclosed differ greatly in size, orientation, position, distribution, number and shape. However, none of the offered solutions to the problem of providing a structurally sound block with great insulating properties, satisfy the current regulations. The following are attempts of the prior art to provide a structurally sound, thermally insulating building block.

In EP 2,598,706 a technique is described for producing an insulated block by placing the insulating panels in the mold before filling the mold with mortar between the insulating panels. Furthermore, a type of block is disclosed wherein the front face of the block and the back face of the block are made of mortar. The front and back face are separated by insulating panels. This greatly improves the insulating properties of these blocks. However, the separating insulating panel can be subject to horizontal deformation across the thickness of the block, as insulating materials are generally far less resistant to pressure than the surrounding building materials. This can cause the blocks to be 'compressed' or 'stretched' horizontally when dealing with great forces and/or pressures. Furthermore, the block proposed in the application does not provide enough strength to be used in the structural support of a construction, unless produced exceedingly thick which will take more building space. This is an unwanted feature when dealing with situations with limited space such as apartments. In addition, the existing block lacks a provision to enable continuity of longitudinal reinforcement throughout the block, such as a rebar.

The invention proposed by said document would have the rebar run through the insulating material, which is not a valid option, as the weaker insulating material would be easily damaged by the rebar. Alternatively this would require an inner layer of mortar to provide a through-hole for the rebar, inside of the insulating panels. This is an impractical solution as it leaves the inner layer of mortar surrounded by insulating material. Again, such a construction will take a lot of space, which is a very unwanted consequence.

U.S. Pat. No. 5,904,963 discloses a block with a plurality of webs defining empty inner cavities with insulating properties. The latter cavities can be filled with insulating material, however air-filled cavities are preferred according to the document. Furthermore, the method to produce blocks of this type is highly impractical, as the web of inner cavities would have very thin walls. A block of this type could only efficiently be made up to a limited height due to viscosity problems when filling the block form, for instance with concrete. This would provide a reduced height compared to other types of blocks, which would allow for new paths for heat transfer through the block laying material (mortar for instance) connecting the separate blocks, thus nullifying much of the advantages in thermal insulation by the bricks. Lastly, no mention is made in the text on the implementation of further supporting materials to allow continuation of longitudinal reinforcement, such as a rebar, into this design.

US 2008/0184650 and US 2001/0022057 both disclose insulating blocks wherein thermal paths through block material are lengthened by the positioning of the cross webbing connecting an intermediate panel of block material to the front and back face. However, the document does not adequately provide a through-hole for rebar, as this would need to be placed in one of the cavities and in order to securely connect it with the insulating block, the entire cavity would need to be filled with a block material such as cement or concrete to ensure a strong interconnection. In doing so, this greatly reduces the insulating characteristics of the block however and makes the block more expensive and heavy due to the unnecessarily high amount of block material. Also, during fabrication of the blocks, the insulation is placed in the block afterwards, which typically will create a gap between the block material and the insulation, in which air is present. Here, a convective air flow can take place which partly negates the advantages of the insulation. Furthermore, and perhaps most importantly, when using the insulating block to build a wall, typically a staggered pattern is used to build the layers. In the case of the proposed block, providing rebar in the cavity of a first layer would mean this rebar runs through an indentation in an above lying layer. However, as this would mean the entrenchment of the rebar in connecting block material there, a direct thermally conducting path would be created via the cross webbings and the entrenching or connecting block material (outer element 110 in US 2008/0184650 or element 16 or 14 in US 2001/0022057). Furthermore, the blocks of the two mentioned documents do not provide an adequate solution for incorporating rebar into their structure, and do not allow an obvious adaptation in order for rebar to be possible, while maintaining high thermal insulation.

In DE 30 11 764 A1 a block is disclosed with non-linear thermal paths from the front face to the back face of the block. However, there is no possibility for the incorporation of rebar, and furthermore, the volume percentage of block material is too high to make this block economically relevant. Lastly, the production of said block would be impractical due to the high amount of thin spaces with insulating material and thin zones of block material.

In EP 0 209 993 A2 a composite block is proposed wherein two separate blocks sandwich a plate of insulating material and are tied together by at least one strap. It would be highly dangerous to use such blocks in construction due to unreliability of the strap considering the conditions in which the block is used, and by using what in fact are two separate blocks, the strength of the composite block is reduced significantly. Lastly, WO 2009/013289 provides a method and machine for producing blocks as mentioned in some of the documents in the general background.

WO 2009/013289 A2 provides a method with which building blocks can be produced, but however fails to achieve in providing a suitable block that is both highly thermally insulating and strong enough to be used in construction, as is achieved by the applicant.

A possible solution for the problems regarding thermal insulation and strength is offered in the form of so-called Thermoblocks® from Marmox. These use extruded polystyrene or polyisocyanurate as a layer of insulating material, but provide strength to the structure by placing pillars of polymer concrete into the layer of insulating material. Polymer concrete provides better thermal insulation than regular concrete, and still provides the strength necessary to ensure the structural stability of the block as a whole. However, even though polymer concrete is a much better thermal insulator than regular concrete or other commonly used materials, it is still far less insulating than 'real' insulating materials. Therefore, by having a multitude of these pillars as is the case in a Thermoblock®, the overall thermal resistance still does not adequately accommodate the needs of the industry. However, a major disadvantage of this solution is that polymer concrete is far more expensive than the commonly used materials for this purpose, and will provide a user a significantly more expensive product. Therefore, the product does not really offer a solution to the problem of providing an economically efficient, thermally insulating block capable of supporting loads. Also, no continuation of longitudinal reinforcement can be provided. As such, when referring to embodiments of the prior art, the Thermoblock® are not included as Thermoblock® fails to meet the goal of the invention of this document in an entirely different way than the previous embodiments, primarily in economic feasibility. Furthermore, Thermoblock® are notably hard to manipulate and process further.

There remains a need in the art for an improved insulated block that is financially interesting, easy to produce and practical to handle, possesses great structural strength and outstanding insulating characteristics and by staying compact, this without sacrificing living space.

The present invention aims to resolve at least some of the problems mentioned above.

The invention thereto aims to provide a structurally high performing, strongly thermally insulating block, which can be easily processed and manipulated (weight, dimensions and other). Furthermore, the invention provides a method for producing said block. Note that thermal insulation both from front face to back face is desired, but also from side face to side face.

SUMMARY OF THE INVENTION

The present invention provides an improved insulating block, while retaining structural stability qualities. This is achieved by a meticulous positioning of insulating material sections throughout at least one cavity, preferably at least one cavity, preferably at least two cavities, in the block, which ensure that the shortest path distance through the block material from the front face of the block to the back face of the block, which ordinarily are the outwards and inwards facing sides of the block, is longer (preferably at least 20%) than the distance from the front face to the back face for providing thermal insulation between the front face and the back face and for increasing strength between the bottom face and the top face. Herein, less than 50%, preferably less than 42%, of the volume of the convex hull of the block consists of block material. More preferably, this is less than 40% or even 35%. The longer shortest path distance makes sure that, even though the path through the block material is much less insulating than a path through insulating material, the path through the block material does not act as a 'hole' in the wall, through which most of the heat will find its way through the wall. However, the block still has a great structural stability in several dimensions. Not only is the block material structured when seen from above to effectively distribute the load it would bear in a construction, it is also able to handle loads coming from the sides by having connections between the front face and the back face in the block material, which is far more resistant to force and pressure than the insulating material. This is especially convenient during manipulation and application of the blocks, when the block could be damaged by forces and pressures in the construction process. Lastly, due to the low amount of actual block material used in the insulating block, costs are reduced and weight as well (easier and faster manipulation). However, due to the design, this does not reduce the resistance to force and pressure from above and below (on top and/or bottom face).

Preferably, the block body has a substantially constant material cross section parallel to the bottom face, over the entire height of the block body. This furthermore allows optimal strength of the block body as it optimally divides the pressure and force of external loads over a larger surface of block material on the top face and/or bottom face (as opposed to several prior art embodiments).

In a preferred embodiment, the block comprises side faces which are oppositely positioned and substantially made of the block material. The side faces connect the front face to the back face and connect the bottom face to the top face. The side faces are each divided in at least two separate sections of the block material, whereby the sections of each of the side faces are separated by interstices comprising the thermally insulating material. The interstices extend from the top face to the bottom face so that a line through the front face and perpendicular to the front face always intersects with the thermally insulating material in the interstices and/or the thermally insulating material in the cavities. Note however that the block material sections of the side faces may (and typically will) be connected with block material in the interior of the block body in a way that lengthens a shortest path through block material from the front face to the back face.

In a further preferred embodiment, the two side faces are oppositely positioned and substantially made of the block material. Furthermore, a shortest path from the first side face to the second side face that only traverses the block material, is always longer than the side faces are distanced from each other. Preferably, this shortest path through the block material between the side faces is always at least 5%, more preferably at least 10% and most preferably at least 20%, 30%, 40%, 50% longer. This reduces heat transfer along the blocks which could lead to heat bridges at certain 'thermal weak spots' in a wall. Preferably this is achieved by ensuring that a shortest path from the first side face to the second side face (typically perpendicular to the front and/or back face) always intersects with at least one of the thermally insulating materials.

In a further preferred embodiment, the block comprises at least one through-hole, preferably two, for a rebar, whereby the through-hole extends centrally from the top face to the bottom face, preferably perpendicular to one or both. The through-hole has walls with a thickness of at least 0.5 cm, preferably of about 1 cm to 1.5 cm, whereby said walls are substantially of block material. The through-hole is dimensioned to, preferably fixedly, receive a rebar of a predetermined diameter, preferably whereby the through-hole has a maximal diameter comprised between 30 mm and 100 mm. By dimensioning the through-hole specifically for the rebar (which typically comprises a substantially cylindrical bar), it is ensured that no, or very little, further filling material needs to be used to secure the rebar in the through-hole. This would need to be a strong material to withstand pressure and force of the rebar, and will typically have a non-insulating nature, thus creating a heat bridge in the through-hole (along with the rebar which also has poor insulating characteristics). In many prior art embodiments, the filling of the cavity for rebar creates a straight path from the front face to the back face of the block.

In a preferred embodiment, the block material comprises at least two openings for rebar in a plane parallel to the front face of the block body, whereby the at least two openings are distanced from each other over a distance equal to about half of the distance between the two side faces, preferably, whereby a first of the at least two openings is distanced from the first side face over a distance equal to about a quarter of the distance between the two side faces and whereby a second of the at least two openings is distanced from the second side face over a distance equal to about a quarter of the distance between the two side faces.

In a further preferred embodiment, the walls of the at least one through-hole for rebar are connected to the front face and to the back face, whereby lines perpendicular to the front face and/or the back face and intersecting the walls of the at least one through-hole, intersect at least one of the thermally insulating materials. In an even further preferred embodiment, said lines intersect at least one of the thermally insulating materials in a section of the line between the walls of the through-hole and the front face, and whereby the lines intersect at least one of the thermally insulating materials in a section of the line between the walls of the through-hole and the back face.

In a preferred embodiment, the insulating block comprises a first through-hole for rebar and a second through-hole for rebar, extending centrally from the top face to the bottom face, whereby the through holes have surrounding walls of the block material, and whereby the first through-hole of the insulating block is designed to align with the first or second through-hole of a second insulating block according to the invention when the insulating block is positioned staggered with respect to the second insulating block, and whereby the second through-hole of the insulating block is designed to align with the first or second through-hole of a third insulating block according to the invention when the insulating block is positioned staggered with respect to the third insulating block. Hereby paths perpendicular to the front face of the insulating block and intersecting the walls of the first or the second through-hole of the insulating block intersect at least one of the thermally insulating materials of the insulating block.

The walls of the through-hole are preferably connected to the front face and/or to the back face and/or to one or more of the side faces by one or more crosslinks made of the block material. The crosslinks extend from the walls to the front face or to the back face or to one of the side faces. The crosslinks furthermore extend from the top face to the bottom face (producing a constant material cross section over the entire height of the block). In a further preferred embodiment, the shortest path from the front face to the back face through the block material extends through at least one of the crosslinks, and preferably through two of the crosslinks (a first crosslink connecting to the front face and a second to the back face).

In a further preferred embodiment, the thermally insulating material in the interstices extends from the side faces to the walls surrounding the through-hole, and whereby the interstices preferably are oriented perpendicularly to the side faces.

In a further preferred embodiment, the thermally insulating material in the interstices is generally shaped like a panel, whereby said panel is oriented parallel to the front face and/or the back face, and whereby the panel has a thickness of at least 0.5 cm, and preferably has a thickness of about 1 cm.

In a further preferred embodiment, the block has a first plane of symmetry equidistant from the front face and the back face, and a second plane of symmetry equidistant from the two side faces.

In a further aspect, the present invention provides a use for the blocks of this invention in the building of at least a part of thermally insulating, structurally stable constructions, such as walls, and on a grander scale, buildings, and in an even further aspect, provides in methods for manufacturing the blocks of the invention.

DETAILED DESCRIPTION OF THE INVENTION

Figure 1:
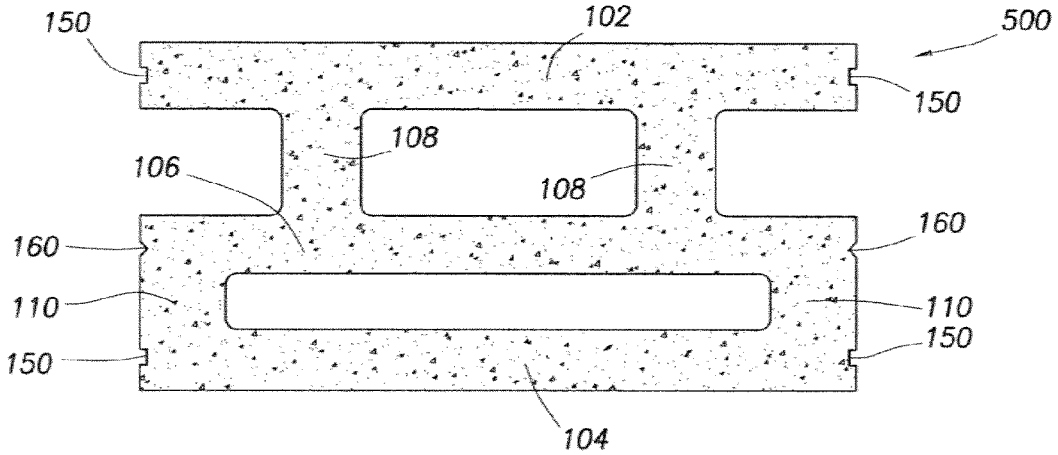
FIG. 1 shows a prior art embodiment of thermally insulating blocks.

The present invention concerns an improved insulating block, a method of producing said improved insulating block and a use for an improved insulating block according to the invention.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

"A", "an", and "the" as used herein refers to both singular and plural referents unless the context clearly dictates otherwise. By way of example, "a compartment" refers to one or more than one compartment.

"About" as used herein referring to a measurable value such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

The recitation of numerical ranges by endpoints includes all numbers and fractions subsumed within that range, as well as the recited endpoints.

The term "block" or "building block" refers to a masonry unit or element used for construction of buildings, such as houses, apartments, commercial dwellings, industrial buildings and others. The terms do not limit the shape, dimensions or material of the blocks in any way possible, and comprises varying embodiments, such as bricks, concrete masonry units (CMU) and others.

The terms "front (face)", "back (face)", "side (face)", "bottom (face)", top "face)" and others refer to the faces of a block which is in a position in which it was intended to be used when building an upstanding wall. Bear in mind that it is possible that no difference exists between certain of these recited elements and that they are interchangeable, and that their separate names does not necessarily indicate a physical difference. For instance, in many practical embodiments, there will not be a difference between the top face and the bottom face, or between the back face and the front face, or between the two side faces. In other embodiments, some or all of these will differ.

The term "block material" refers to building materials meant for structural strength, commonly or uncommonly used in the construction of blocks and other construction components. A typical example of the block material most commonly used is concrete (in many embodiments, such as nano concrete, microbial concrete, high performance concrete (HPC), self-consolidating or self-compacting concrete (SCC)), however the term is not limited thereto and can comprise any block material conceivable by a person skilled in the art.

The term "insulating material" or "insulation" or "insulation material" refers to all commonly used products for building applications, and also to less common products with known insulating properties, not necessarily used for building applications. A few examples of these include the following, but are not limited thereto: (silica) aerogel, polyurethane (in many adaptations, for instance expanded)), polyisocyanurate (PIR), phenolic spray foam, phenol formaldehyde, thinsulate insulation, urea-formaldehyde, urea foam, polystyrene (for instance expanded polystyrene, or extruded polystyrene), fiberglass batts, rice hulls, cotton batts, icynene, rock and slag wool, cellulose, polyethylene (foam), perlite, vermiculite, papercrete, glass wool, hemp, sheep wool, cork, straw, foam glass, mineral wool, and others conceivable by a person skilled in the art. Choices can be made herein to cater to particular applications, depending on difficulty, budget, structure and other parameters. Furthermore, the invention might comprise several different parts that comprise insulating material. It is possible for all these parts to be made of the same material, or that some parts differ from others. Therefore, when speaking of 'first' and 'second' thermally insulating material, this does not necessarily mean these are different materials, but merely physically separated elements. Consequentially, every time the term "isolating material" is used, this does not limit the material it comprises.

The term "rebar" refers to reinforcing steel, and commonly comprises steel bars, used as a tension device to strengthen and hold the surrounding structure in tension. Furthermore, this can be supplement with filling material for anchoring the rebar securely to the block.

The term "length" refers to the distance between the two side faces. The term "depth" or "breadth" refers to the distance between the front face and the back face. The term "height" refers to the distance between the bottom face and the top face.

The term "shortest path length through (the) block material" or "shortest length through (the) block material" or "shortest path through (the) block material" refers to paths from the front face to the back face of the block with a minimal length, with the condition that said paths only pass through the block material.

In a first aspect, the invention provides anf improved insulating block which provides great structural stability. The block comprises a general block body made of a block material, with the block having a front face and a back face made of block material and whereby the block body is adapted so it comprises at least one cavity (preferably at least two cavities) and/or intrusion of which some or all are filled with thermally insulating materials in order to make the entire block generally shaped like a cuboid without substantial 'empty' cavities. Optionally however the block can comprise a (partly empty) through-hole running through the block from a top face to a bottom face of the block, whereby the through-hole is surrounded by walls comprising block material. These walls surrounding the through-hole can have a general cylindrical design, though rectangular, square, polygonal and other profiles are also possible. The insulating material is positioned to ensure that a line through the front face and perpendicular to the front face always intersects with the thermally insulating material. However, the front face and the back face are connected through at least one path comprising only the block material. Preferably, the cross sections of the block parallel to the bottom face are substantially equal. By connecting the front face and the back face with the block material, the strength of the block is improved with respect to horizontal pressures and forces, for instance impacts against the front or back face of the block. Furthermore, this improves the resistance to vertical forces as this enlarges the bearing surface of the block which is made of block material, as this will provide most of the resistance as opposed to the more compactible thermally insulating material. Should structurally strong thermally insulating material be used, this would be further preferred, even more so if this were economically viable and/or easy to use. However, by ensuring that no straight connection is made through solely block material, this allows for strongly heightened insulating characteristics, as the path of the lowest thermal resistance from the front face to the back face, generally runs purely (or primarily) through the block material. By ensuring that no straight line can be made from the front face to the back face through the block material, the path length is heightened and the thermal resistance of this path is heightened as well. Further advantages of these configurations are discussed in what follows.

In a preferred embodiment of the invention, the invention provides an improved insulating block comprising a block body whereby the block body is made of a block material. The block comprises a top face, a bottom face, a front face, a back face and two side faces, whereby the back face is parallel to the front face, and at least one cavity, preferably at least two cavities. Said cavity extends from the top face to the bottom face and comprises a thermally insulating material. The front face and the back face are connected to each other by the block material. The block is furthermore adapted in that a shortest path from the front face to the back face through only the block material is always longer than the front face is distanced from the back face, preferably at least 5% longer, more preferably at least 20% longer and most preferably at least 50% longer than the front face is distanced from the back face, for providing thermal insulation between the front face and the back face and for increasing strength between the bottom face and the top face. This is in part accomplished by the positioning of the cavities. Preferably the block comprises 2 to 6 cavities filled with thermally insulating material, however other numbers of cavities such as 1, 3, 4, 5, 7, 8, 9, 10 or more, such as 15, 20, and 30 are also possible or any numbers in between. The block is characterized in that the block material represents less than 42% of the volume of a convex hull of the block body, preferably even less than 40% and more preferably less than 35%. This not only accommodates the use of the building block (being lighter) but will also make it cheaper to produce, as a greater part of it can be (cheaper) insulating material. In prior art blocks, a very high percentage of the block volume still consists of the block material, even in a form where no rebar is applied. This is made far worse when rebar is incorporated in the prior art designs. The applicant has solved this by providing a structurally resilient structure (capable of resisting high pressures and forces substantially perpendicular to the top and bottom face of the block), with excellent insulating characteristics.

The proposed configuration of the block solves the problem that, despite the existing examples of incorporation of thermally insulating materials in the cavities of the block body, the known designs still are faced with similar flaws among the known designs. In a first solution, these attempt to provide optimal thermal resistance by having a slab or panel of thermally insulating material between the front face and the back face of the block, which are made of block materials such as concrete or others, thus disabling a straight connection between the front face and the back face, through thermally less resistant material, such as the block material. However, as the thermally insulating material is a poor structural component and not capable of resisting pressures and forces with deforming or even being damaged, the solutions of the inventions of the prior art fail to provide with a block that is a structurally sound component for buildings. For instance, forces and pressure coming from the sides of such blocks are poorly managed and can cause contractions of the depth of the block so made. Furthermore, also forces and pressure which are vertically oriented, are poorly managed, as these are mainly supported by the outer front face and back face of the block, as the thermally insulating slab there in between is not fit to bear high amounts of weight. Again, this poses serious structural dangers, even when added precautions are taken. In a second solution, the design of the blocks is focused on the structural qualities they provide and, while incorporating insulating material internally in the block body, still too many connections are made between the front face and the back face through the block material. These connections are channels for heat to flow easily from the front face to the back face or vice versa very easily. The invention as described in this document solves these problems by having a block with internal cavities filled with thermally insulating materials, but whereby the shortest path through the block material from the front face to the back face of the block is always longer than the distance between the front face and the back face for providing thermal insulation between the front face and the back face and for increasing strength between the bottom face and the top face. Preferably, the shortest path is at least 5%, 10%, 15%, 20%, 25%, 30%, 35%, 40%, 50%, 60%, 70%, 80%, 90%, 100%, 125%, 150%, 175%, 200% or even more, longer than the distance from the front face and the back face, while less than 42% (or less than 41%, 40%, 39%, 38%, 37%, 36%, 35%, 34%, 33%, 32%, 31%, 30%, 28%, 26% or even less, depending on both the structural requirements of the block and the specific design) of the volume of the convex hull of the block comprises block material. It is further of note that insulating material will substantially form the rest of the volume of the convex hull, save the volume reserved for rebar. This design ensures that the shortest path through the block material, which is far more thermally conductive than the insulating material (for instance, the thermal conductivity of concrete is easily over 2 W/(m·K), while the thermal conductivity of polyurethane, a possible insulation material can be around 0.02 W/(m·K), a difference of a factor 100), will be longer than the shortest distance between front and back face, thus increasing thermal insulation characteristics of the block as a whole. The shortest path through the block material will for these reasons provide a preferred channel for the heat to pass through. Therefore, by lengthening this shortest path through the block material, the total thermal resistance of the shortest path through the block material will grow, and this will severely reduce the advantages of this shortest path which could serve as a thermal bridge, thereby having a substantial effect on the thermal conductivity of the block as a whole. By ensuring there is a block material connection between the front face and the back face of the block, stability and structural resistance is ensured, as these connections will both partially support vertical loads, as well as provide resistance against horizontal forces and pressure, which could normally cause deformations in the insulating material and therefore deformations to the block.

In a further preferred embodiment, the block has a substantially constant material cross sections parallel to the bottom face. This eases the production process as the blocks can be made in a formwork. Furthermore, this ensures that a similar thermal conductivity applies to the block at every of these horizontal cross sections, and that there are no weak points which could serve as thermal bridges for heat traversing from the front face to the back face or the other way around.

In a preferred embodiment, the two side faces are oppositely positioned and substantially made of a block material, preferably the same block material as the front face and the back face. The side faces connect the front face to the back face and connect the bottom face to the top face, and said side faces are each divided in at least two separate sections of the block material, whereby the sections of each of the side faces are separated by interstices, which run from the top face to the bottom face. The interstices comprise the thermally insulating material (or another type of insulating material), and the interstices (and the thermally insulating material therein) extend from the top face to the bottom face in such a way that a line through the front face and perpendicular to the front face always intersects with the thermally insulating material in the interstice and/or with the thermally insulating material in the cavities. When using the term "section" to describe the division of the side faces, it refers to the fact that the block material on each side face is at least visibly separated in two or more separate sections of the block material per side face, and thus does not extend from the front face to the back face in one piece. This is further observable in FIG. 2-6. A common problem with many of the blocks described in the prior art, is that a straight channel from the front face to the back face remains on the side faces of the block, as these are commonly made of a full slab of block material, which presents a preferred channel for heat transfer with its low thermal resistance. To make matters worse, these full slabs allows a shortest path length which is equal to the distance between the front face and the back face. Thus, even though these embodiments comprise thermally insulating materials in the block, the fact remains that a great part of heat will still be transferred from one side to the other (front face to back face of vice versa) through the block material side faces of the blocks in the prior art. The invention solves this problem by interrupting the side faces into separated surfaces of block material on each side face, thus removing the short path in the block material along the side faces that plague known renditions of insulating blocks. This is however accomplished without undermining the resistance of the block to forces and pressure, both vertical as horizontal, as is the case in known blocks. The invention solves this by having a connection between the front face and the back face in the block material as was mentioned earlier. The fact that this connection is longer than the usual connection from front face to back face (this is accomplished by the side faces in prior art blocks), even strengthens the improved blocks further, as the bearing surface of the block material for vertical loads is bigger. Furthermore, when using blocks to build a wall, the blocks are often placed in layers in a staggered formation. When using rebar, this typically means that one or more through-holes need to be provided in such a way that it ensures the rebar running vertically through several layers. In many of the prior art blocks, this would result in the creation of a direct path from front face to back face through block material or filling material (which has similar insulating properties) and a heat bridge as such. The invention prevents this as can be seen in the figures.

In a further preferred embodiment, the separate sections of the first side face are connected by a first indented arch of the block material, and whereby the separate sections of the second side face are connected by a second indented arch of the block material, whereby the first and second arches of the block material each comprise two inwardly extending paths of the block material which are connected by a bridge of the block material, and whereby the arches each define one of the interstices, preferably whereby the inwardly extending paths each extend inwardly over at least 10% of the length of the block. More preferably, these paths extend inwardly even further, for instance at least 15% of the length of the block, 20% of the length of the block, 25% of the length of the block, 30% of the length of the block, 35% of the length of the block. Alternatively, the length of these paths can be measured with respect to the depth of the block (distance from front to back face), and as such, preferably these paths extend inwardly over at least 15%, 20%, 25%, 30%, or more, of the entire depth of the block, thus lengthening the shortest path with at least 30%, 40%, 50%, 60%, or more. The arch-form ensures that the shortest path through block material from front face to back face will lead first inwardly, then back outwardly, thus increasing the total path length doubly. Note that the shape of these arches is not limited to one certain form, it however is preferably shaped like a Greek capital letter 'Pi': Π, as can be seen in several of the figures.

In a further preferred embodiment, the two side faces are oppositely positioned and substantially made of the block material, characterized in that in between the front face and the back face, a shortest path from the first side face to the second side face through only the block material is always longer than the side faces are distanced from each other, preferably at least 5% longer, more preferably at least 10% longer, most preferably at least 20% longer. By ensuring that there is no 'straight', shortest path through the block material between the side faces, lateral heat transfer is impeded to avoid the creation of heat bridges at thermal weak spots, a risk which is not averted in many prior art insulating blocks.

In further preferred embodiment, the block comprises at least one through-hole for a rebar, extending centrally from the top face to the bottom face, preferably perpendicular to one or both. The through-hole is surrounded by walls with a thickness of at least 0.5 cm, or preferably of about 1.0 cm to 1.5 cm, although other thicknesses, such as 1.1 cm, 1.2 cm, 1.3 cm, 1.4 cm, 1.5 cm, 1.6 cm, 1.7 cm, 1.8 cm, 1.9 cm, 2.0 cm, 2.1 cm, 2.2 cm, 2.3 cm, 2.4 cm, 2.5 cm, 2.6 cm, 2.7 cm, 2.8 cm, 2.9 cm, 3 cm, 3.25 cm, 3.5 cm, 4 cm or values there in between, may also be considered. Preferably, the through-hole is designed and dimensioned to fixedly receive a rebar of a predetermined diameter. Note that this can be dependent on the requirements for the block dictated by the specific situation. Said walls are substantially of block material, preferably the same block material as the front face and the back face. The walls are preferably connected to the front face and/or to the back face and/or to one of the side faces by one or more crosslinks made of the block material, whereby the crosslinks extend from the walls to the front face, or extend from the walls to the back face, or extend from the walls to one of the side faces. The crosslinks extend over the entire height of the block, from the top face to the bottom face.

In a possible embodiment, two crosslinks extend from the walls to the front face and/or two crosslinks extend from the walls to the back face. Even more preferably, one or more crosslinks extend from the walls to the side faces, most preferably two crosslinks from the walls to each of the side faces. Generally, it is preferred that the crosslinks are placed under a certain angle with the front face and the back face, as this will increase the total path length through the block material from the front face to the back face, when going through the crosslinks. The crosslinks from the walls to the same side face are preferably separated by the thermally insulating material. By providing a through-hole that is not installed post-production, the integrity of the structure is not compromised, for instance by drilling a through-hole. Furthermore, by reinforcing around the through-hole with block material, and using the reinforcing walls around the through-holes as an anchoring point to provide crosslinks to other faces of the block (front, back and side faces), a greater strength and resistance is provided.

In a possible embodiment, two crosslinks extend from the walls to the first side face of the block, whereby said two crosslinks are separated by a thermally insulating material, and are only connected by block material through the walls of the through-hole. Two crosslinks furthermore extend from the walls to the second side face of the block, whereby said two crosslinks are separated by a thermally insulating material as well, and only connected by block material through walls of the through-hole. Optionally, further crosslinks may be provided, connecting the walls to the front and/or back face of the block. Said thermally insulating material separating the two crosslinks is a continuation of the thermally insulating material that separates the sections of the side faces. In this embodiment, each of the sections of the side faces is connected to the walls surrounding the through-hole by one of the crosslinks. Preferably, each side face comprises two of the sections, however more sections are possible, for instance should the blocks be made with other dimensions as this could allow greater flexibility. Again, the proposed construction provides greater strength, as the walls around the through-hole are designed to absorb at least part of the forces and/or pressure exerted on the outside faces of the block, which are transferred partly to the walls through the crosslinks. Preferably the crosslinks are straight in order to ensure an efficient transfer of the forces to the walls.

The diameter of the through-hole(s) is preferably comprised between 30 mm and 150 mm, for instance 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 105 mm, 110 mm, 115 mm, 120 mm, 125 mm, 130 mm, 135 mm, 140 mm, 145 mm, 150 mm, or any values therein between. More preferably it is comprised between 40 mm and 100 mm, even more preferably comprised between 45 mm and 80 mm. The crosslinks can absorb part of horizontal pressure and forces that are applied on the front face and the back face of the block, and furthermore, provide a larger bearing surface for vertical pressure and forces. The presence of one or more of these through-holes in the blocks enables the continuity of longitudinal reinforcement elements, such as a rebar. These elements allow a transfer of forces and pressure between structural elements above and beneath the block, thus reducing the strain on the block itself. This is even more useful for blocks which are the bearing elements in a structure, as they can transfer part of their load to a floor or other elements which are exceedingly fit to handle such forces and pressure.

Preferably the walls around the through-hole are generally cylindrical, as this provides an optimal resistance to external (radially inwardly oriented) forces, whereby the walls are oriented so that the central axis of the cylindrical walls extends from the top face to the bottom face, most preferably perpendicular to one or both. It is possible for certain elements to be made thicker or from another material if greater strength or other characteristics are desired. Such adaptations are comprised in the scope of the invention as put forward in this document. The advantages of having one or more through-holes for rebar constructions are known. Having the reinforced walls around the through-hole means that the rebar constructions cannot damage insulating material around it, and again offers a greater bearing surface for vertical forces and loads placed on top of the improved block. As the walls around the through-hole generally are quite central to the block, they are positioned optimally for partly discharging the vertical forces and pressures on the improved block. Furthermore, as the crosslinks could provide a thermal bridge from the front face to the back face, these are designed to be as narrow as possible in order to only mildly reduce the thermal resistance of the block as a whole, even more so as even through the crosslinks, the path length is still higher than in insulating blocks known in the prior art.

In a preferred embodiment, the block comprises two through-holes for rebar, whereby said two through-holes are preferably positioned to allow alignment of through-holes of different blocks when said blocks are placed in layers with a staggered formation. The walls of each through-hole are each connected by block material to a different side face. Optionally, the walls of the two through-holes are connected to each other by block material. This can be a single connection, or two separate connections, separated by thermally insulating material. The connection of the walls to the side faces is preferably designed so as to have two separate connections or crosslinks for the wall of one the through-holes to a side face, whereby said separate connections are separated by thermally insulating material which also separate the side face into two sections of block material, which are separated by the thermally insulating material that separates the separate connections between the walls and the side face.

In a further preferred embodiment, the shortest path from the front face to the back through the block material extends through at least one of the crosslinks. Preferably, it extends through two of the crosslinks. By reducing the number of connections through block material from the front face to the back face, or at least substantially through the block material, or narrowing the possible paths through the block material, the thermal conductivity of the entire block from the front face to the back face is severely reduced, thus making it a far better insulator. This is achieved by only creating paths from the front face to the back face through the block material where it is desired for structural purposes, and even then, making them only as broad as needed, and taking further precautions to lengthen the total path from front to back face through the block material, as these connections will most likely remain the 'easiest' path from front to back for heat transfer. In a possible embodiment, this is accomplished by the crosslinks which extend from the front face and/or the back face under an angle of at most 70°, preferably at most 60°, more preferably at most 55°, and possibly at angles of at most 50°, 45°, 40°, 35°, 30°, 25°, 20°, 15°, 10°, 5° and less, with respect to the front face and/or the back face. However higher angles are still possible. Alternatively, no crosslinks are connected to the front face or the back face directly.

The crosslinks preferably extend from the bottom face to the top face, so the horizontal cross section of the block remains the same at each point. The term "horizontal cross section", refers to a cross section of the block, parallel to the bottom face and/or the top face of the block. This is especially advantageous as it creates a solid base for vertical loads, forces and pressure on the bottom face and/or the top face. Most forces etc. that are placed on the top face will be perpendicular to the bottom face and/or the top face, and therefore, the fact that the crosslinks extend from the bottom face to the top face, preferably perpendicular to the bottom face and/or the top face, optimally provides support to accommodate these forces etc.

In a further preferred embodiment, the block material comprises concrete. Preferably, the block material comprises high performance concrete (HPC), more preferably with a compressive strength of at least 40 MPa, even more preferably with a compressive strength of at least 60 MPa, even further more preferably of at least 80 MPa. Even higher compressive strength can be provided, such as 100 MPa, or 120 MPa. In a further preferred embodiment, the thermally insulating material comprises polyurethane and/or polystyrene, preferably expanded polyurethane and/or polyurethane foam and/or extruded polystyrene.

In a further preferred embodiment, the thermally insulating material in the interstices extends from the side faces to the walls surrounding the through-hole. The interstices are preferably oriented perpendicularly to the side faces. This allows for more symmetry and a stronger structure. However, the interstices can also extend non-perpendicularly to the side faces, as this can improve thermal insulation by extending the paths through the block material further. Usually in the blocks known from the prior art, the shortest path length from the front face to the back face through block material, goes by the sides of the block, which generally are entirely made of the block material and thus form a straight path through the block material and thereby create a thermal bridge from front to back. By 'breaking' this straight path, a longer path is created already. However, by extending the interstices to the walls around the through-hole, the path from front to back, which goes by the side faces of the block, is made much longer and thus creates a much higher thermal resistance.

In a further preferred embodiment, the thermally insulating material in the interstices is generally shaped like a panel, whereby said panel is oriented parallel to the front face and/or the back face. The panel has a thickness of at least 0.5 cm, more preferably of at least 0.6 cm, 0.7 cm, 0.8 cm, 0.9 cm and preferably a thickness of about 1 cm. Optionally, the thickness of the panel is higher than 1 cm, such as 1.1 cm, 1.2 cm, 1.3 cm, 1.4 cm, 1.5 cm, 1.75 cm, 2 cm, 2.25 cm, 2.5 cm, 2.75 cm, 3 cm, 3.5 cm, 4 cm or even more. All interlying values are comprised, but the thickness is in no way restricted thereto. The minimal thickness of this panel is to ensure that a thermal bridge is not created that would traverse a too thin layer of the insulating material. Generally, the insulating material has a thermal conductivity that is at least 10 times lower than that of the block material. This way, a layer of 1 cm of the insulating material is equal to at least 10 cm of the block material, thus creating a significantly higher thermal resistance. In reality the thermal conductivity of the block material is far more than 10 times higher than that of the insulating material, further preventing a hidden 'shortest thermal path'.

In a further preferred embodiment, the block has a first plane of symmetry equidistant from the front face and the back face. The block has a second plane of symmetry equidistant from the two side faces. Again, this makes the production process of the blocks easier, and allows easier handling as there is no real distinction between the side faces, or between the front face and the back face.

In a preferred embodiment, the block material comprises two through-holes for rebar in a plane parallel to the front face of the block body, whereby the two through-holes are distanced from each other over a distance equal to about half of the distance between the two side faces. Preferably, a first of the two through-holes is distanced from the first side face over a distance equal to about a quarter of the distance between the two side faces and whereby a second of the two through-holes is distanced from the second side face over a distance equal to about a quarter of the distance between the two side faces. Furthermore, it is preferred that the walls of the through-holes is not connected to the front face and not connected to the back face via block material paths that are perpendicular to said faces (so-called shortest paths). By doing so, it is guaranteed that there will not be a shortest path through exclusively block material (and optionally rebar and/or filling material which have a similarly bad insulating properties), even when providing a rebar in the through-holes and optionally further filling the through-hole to entrench the rebar.

In a preferred embodiment, the walls of the at least one through-hole for rebar are connected to the front face and to the back face, whereby lines perpendicular to the front face and/or the back face and intersecting the walls of the at least one through-hole, intersect at least one of the thermally insulating materials. Even more preferably, the lines intersect at least one of the thermally insulating materials in a section of the line between the walls of the through-hole and the front face, and the lines intersect at least one of the thermally insulating materials in a section of the line between the walls of the through-hole and the back face.

In a preferred embodiment, the insulating block comprises a first through-hole for rebar and a second through-hole for rebar, extending centrally from the top face to the bottom face, whereby the through holes have surrounding walls of the block material, and whereby the first through-hole of the insulating block is designed to align with the first or second through-hole of a second insulating block according to the invention when the insulating block is positioned staggered with respect to the second insulating block, and whereby the second through-hole of the insulating block is designed to align with the first or second through-hole of a third insulating block according to the invention when the insulating block is positioned staggered with respect to the third insulating block; and whereby paths perpendicular to the front face of the insulating block and intersecting the walls of the first or the second through-hole of the insulating block intersects at least one of the thermally insulating materials of the insulating block.

In a preferred embodiment, the block has a length comprised between 15 cm and 75 cm. Preferably the length is comprised between 20 cm and 50 cm, and most preferably the length is about 30 cm. The block has a depth comprised between 10 cm and 35 cm. Preferably the depth is comprised between 12 cm and 25 cm, and most preferably, the depth is about 15 cm or about 20 cm. The block further has a height comprised between cm and 75 cm. Preferably the height is comprised between 12 cm and 25 cm and most preferably about 15 cm. Alternatively, the height can be higher, for instance between 25 cm and 60 cm, preferably 50 cm. Furthermore, the block can have a depth or breadth of the block can be comprised between 20 cm and 40 cm, preferably between cm and 35 cm, and most preferably about 30 cm.

In further preferred embodiment, the block material that constitutes the front face and the back face and at least partly the side faces, has a thickness of at least 0.5 cm, preferably about 1.0 cm. Other possible values for said thickness can be 0.6 cm, 0.7 cm, 0.8 cm, 0.9 cm, 1.1 cm, 1.2 cm, 1.3 cm, 1.4 cm, 1.5 cm, 1.75 cm, 2 cm, 2.25 cm, 2.5 cm, 2.75 cm, 3 cm, 3.25 cm, 3.5 cm, 3.75 cm, 4 cm, 4.5 cm, 5 cm and all values in between. Said thickness is however not limited thereto. The choice lies in the needs of the situation, but also in the choice of material, budget, environment and other parameters. A high enough thickness is suggested to allow easier manufacturing of the blocks, and also to guarantee a high enough strength for the structure that is to be constructed with the blocks.

The choice for the aforementioned dimension lies in practicality for the manufacturing of the blocks if use is made of flowing block material that solidifies in a formwork. As the formwork used to make such blocks would need very narrow channels in which the block material is poured, the height of the block will be limited, in order to make sure the flowing block material will fill the entire formwork. If the height is too high, the block material might already start solidifying before reaching the bottom of the formwork, thus creating an inadequate block. Furthermore, for practical purposes, the dimensions, and the weight, of the block would need to be limited in order for machine and/or people to handle the blocks. Therefore, the blocks should have a maximum weight of 100 kg, or 90 kg, or 80 kg, or 75 kg, or 70 kg, or 65 kg or 60 kg, or 55 kg, or 50 kg, or 45 kg or 40 kg, or 35 kg or 30 kg, or 25 kg, or 20 kg, or 15 kg. Heavier blocks could be made when the handling of the blocks is done with machinery designed to handle these blocks, thus having blocks with a higher maximal weight, for instance 150 kg, 200 kg, 250 kg or more.

In a preferred embodiment, the block has an average thermal conductivity from the front face to the back face below or equal to 0.2 W/(m·K). The average thermal conductivity is preferably below or equal to 0.1 to W/(m·K), and more preferably below or equal to 0.05 W/(m·K). All inter interlying values are comprised as well, such as 0.15 W/(m·K), 0.12 W/(m·K), 0.09 W/(m·K), 0.08 W/(m·K), 0.07 W/(m·K), 0.06 W/(m·K) and others. However, even lower values, such as 0.04 W/(m·K), 0.03 W/(m·K) are encouraged as these provide even stronger insulation between front face and back face.

In a further preferred embodiment, the block has a maximal thermal conductivity for a path from the front face to the back face that is perpendicular to both the front face and the back face, henceforth referred to as a straight path. This maximal thermal conductivity is below or equal to 0.5

W/(m·K). More preferably, this is below or equal to 0.4 W/(m·K), or even more preferably yet lower. In an even further preferred embodiment, straight paths with the maximal thermal conductivity constitute less than 10% of the entire block. More preferably, it constitutes less than 7.5% of the entire block and most preferably less than 5%. Furthermore, it is preferable that straight paths with a thermal conductivity which is above 75% of the maximal thermal conductivity constitute less than 15%, preferably less than 10% and most preferably less than 7.5% of the entire block. Even furthermore, it is preferable that straight paths with a thermal conductivity which is above 50% of the maximal thermal conductivity constitute less than 20%, preferably less than 13% and most preferably less than 7.5% of the entire block. These specifications further reduce the danger of having one or more thermal bridges which would allow easier heat transfer and potentially damage the insulating characteristics of the block. The configuration of the block as provided in this application ensures the insulating properties of the block.

Furthermore, it is desired that the block has an average thermal resistance from the front face to the back face of at least 0.75 $m^2$·K/W, preferably of at least 1.5 $m^2$·K/W, more preferably of at least 2 $m^2$·K/W and most preferably of at least 3 $m^2$·K/W. All interlying values are comprised as well. Furthermore, even higher values for the average thermal resistance are encouraged as these provide a stronger insulation between the front face and the back face. The term "average thermal resistance" refers to thermal resistance of the block as a whole, from the front face to the back face.

In a possible embodiment, the block material comprises jagged extensions extending from the block material into thermally insulating material. These extensions are present in the interior of the block body and can extend from the front face and/or from the back face and/or from one or two of the side faces, and preferably run along the entire height of the block. The extensions can be shaped with a square, a rectangle, a triangle, a parallelogram, a trapezoid (preferably whereby the large base faces away from the block material), or curved figures, or other elements as cross section.

In a further possible embodiment, the block material of the front face (and/or the back face) is provided with openings to the insulating material inside of the block. Said insulating material can in this way provide acoustic quieting. Preferably, the insulating material is also acoustically damping, for instance glass wool In a second aspect, the invention provides a use of an improved insulating block as described in this document, as at least the first layer of a wall, in order to reduce thermal conductivity for the wall as a whole. Furthermore, it provides a use of the improved insulating block for insulating a wall or other structure against thermal bridges at the first layer from the floor. Furthermore, it provides a use of the improved block in a wall of a building, a wall between a space intended to be heated and a space intended not to be heated.

The use of the improved block for the first layer of a wall is especially useful, as commonly specialized blocks are used for this first layer which need excellent thermal qualities. However, such blocks are often exceedingly expensive and provide insufficient insulation. The block disclosed in this document offers a solution due to its excellent insulation properties, structural strength and cost-effective design, material choice and production method. As a first layer of a wall often is the most important with respect to insulation in combination with a floor, it is preferably that at least the first layer is built with the block of this invention, and preferably higher layers as well.

In a third aspect, the invention comprises a thermally insulating wall (or more general, a structure) comprising of a plurality of the blocks of the invention, whereby said blocks are preferably stacked in a staggered fashion. Preferably, the blocks have a through-hole for rebar as described in this document, and the wall or structure comprises at least one rebar extending through the holes of several of the blocks. A structure built of the blocks of the invention of course provides the advantages previously identified in this document, but especially optimizes walls with rebar, as opposed to prior art embodiments, the block effectively removes any danger of presenting a direct, straight path through material with poor insulating characteristics, even when rebar is present (optionally with filling material). As such, a structure built thusly will provide optimized insulation, combined with an excellent structural strength.

In a fourth aspect, the invention comprises methods of manufacturing the blocks of the invention. A first of such methods comprises the following steps:

a. providing a formwork shaped to encompass the finished block;
b. placing one or more pieces of preformed thermally insulating material in the formwork, preferably two or more of said pieces whereby said pieces are separated from each other and extend from the bottom to the top of the formwork;
c. providing the flowing block material in the formwork, whereby the flowing block material fills the formwork and fills spaces between and around the insulating materials in the formwork;
d. optionally allowing the block to solidify and removing the solidified block from the formwork;

whereby the thermally insulating material and the formwork is placed in a manner that a shortest path from the front face to the back face through the block material is always longer than the front face is distanced from the back face, preferably at least 20% longer, more preferably at least 30% longer and most preferably at least 50% longer. Furthermore, this technique will ensure a perfect fit between block material and insulating material.

Alternatively, the method comprises the following steps:

a. providing a formwork shaped to encompass the finished block, said formwork comprising one or more extrusions which extend upwards in the formwork from the bottom to the top of the formwork;
b. providing the flowing block material in the formwork, whereby the flowing block material fills the formwork and fills spaces between and around the extrusions in the formwork;
c. allowing the block material to turn solid;
d. removing the solidified block from the formwork;
e. providing the thermally insulating material in the cavity in the solidified block, said cavity being formed by the extrusions of the formwork;

whereby the extrusions are provided in a manner such that after filling the formwork with the block material, a shortest path from the front face to the back face through the block material is always longer than the front face is distanced from the back face, preferably at least 20% longer, more preferably at least 30% longer and most preferably at least 50% longer.

The two methods discussed are able to expertly produce the specific blocks of the invention by providing either preplaced thermally insulating material in the formwork, around which the block material can be poured, or providing a formwork that has extrusions around which the block material can be poured, and produce the one or more cavities in which thermally insulating material can later be placed. The positioning of the extrusions or preformed pieces of insulating material differ from that disclosed in prior art, and succeed in producing a thermally insulating as well as structurally sound building block. Note that the shape of the formworks with extrusions or preplaced pieces of thermally insulating material can be easily derived from the figures disclosed in this document, and from further disclosures in this document.

The invention is further described by the following non-limiting examples which further illustrate the invention, and are not intended to, nor should they be interpreted to, limit the scope of the invention.

The present invention will be now described in more details, referring to examples that are not limitative. Note that based on the figures, it can easily be determined what the volume percentage is of the block material or the insulating material. Furthermore, the dimensions of the figures, or the ratios there between, should not be considered as absolute. The dimensions can vary, and the figures are meant to indicate a design in a general fashion.

EXAMPLES

Example 1

Prior Art

In this example, a commonly known prior art embodiment is discussed, as can be found in FIG. 1. This embodiment attempt to address the concept of blocks with thermally insulating properties. As stated before, most of these concepts fail in producing structurally sound blocks, as well as sufficiently insulating.

In the example of the figure, the block has three panels which are connected through crosslinks These crosslinks do not extend over the entire height and though creating a reduced thermal conductivity have little to no effect on the structural strength of the block. Furthermore, the block as proposed in the document does not allow proper incorporation of a rebar material such as a bar, while still maintaining strength and reducing thermal conductivity. Instead, when using rebar, one of the cavities of the block will need to filled with a strengthening material, typically concrete, which thus leads to a thermal bridge from the front face to the back face being present. Since a single occasion of such a thermal bridge wreaks havoc the efficiency of the entire block (and the entire wall or structure), the presence of such a thermal bridge will cause a thermal weak spot. Even more, if the blocks are used in a staggered formation for building a wall, the use of rebar will always create such a thermal bridge.

Example 2

Basic Configuration

Figure 2:
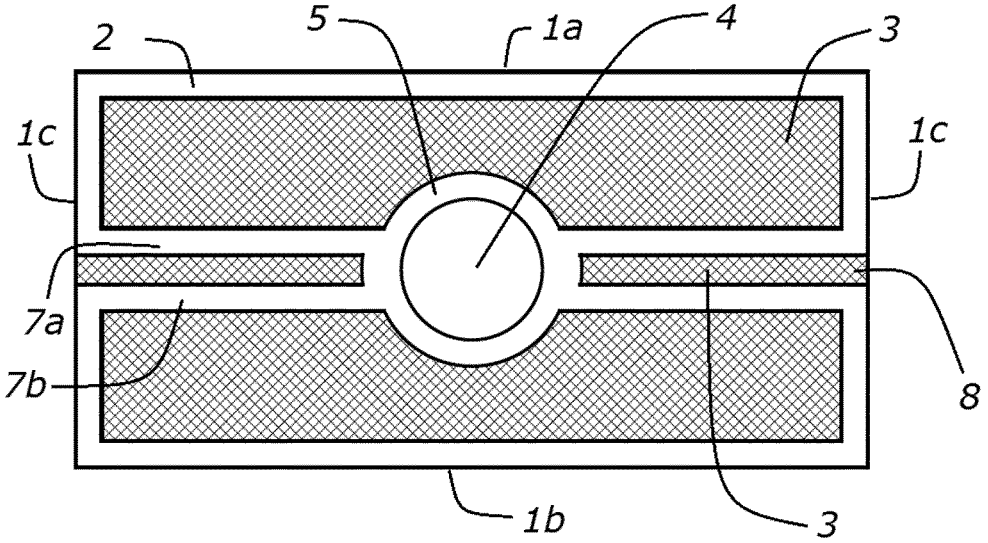
FIGS. 2, 3, 4, 5, 6, 7, 8, 9, 10, 11, 12, 13, 14, 15 and 16 show embodiments of a block according to the invention.

In a first possible embodiment, of which a top view is shown in FIG. 2, the block body comprises a single connected skeleton made of the block material (2), comprising cavities and a through-hole (4), surrounded by walls (5) of the block material (2). Note that the cross section seen in FIG. 2 extends across the entire height of the block. The side faces (1*c*) of the block are divided in two sections by interstices (8), which are filled with the insulating material (3). The side faces (1*c*) are connected to the walls (5) around the through-hole (4) by connections (7*a*, 7*b*) comprising the block material (2). As the insulating material (3) provides a thick thermally insulating layer in a central zone of this design, barely any heat transfer will be possible through this central zone. The heat transfer will primarily use the thermal bridge through the block material (2) which has a much higher thermal conductivity. As such, heat transfer from the front face (1*a*) to the back face (l*b*) will mainly be transferred through a first section of the side faces (1*c*), then through a first connection (7*a*) of the side faces (1*c*) to the walls (5), then through a second connection (7*b*) of the walls (5) to the side faces (1*c*) and then through a second section of the side faces (1*c*). From a thermal standpoint, this will present the easiest path for heat transfer. However, as can be seen from FIG. 2, this path is also much longer than should there be a straight block connection between the front face (1*a*) and the back face (1*b*), for instance should the side faces (1*c*) not be divided into two sections. In the currently shown embodiment, the shortest path is easily twice as long as a straight connection would be, and thus doubles the thermal resistance of this 'easiest' path, or halves the thermal conductivity of it. By doing so, the overall (or average) thermal conductivity of the entire block is lowered as well. This is achieved without losing the strength and resistance of the block as a building block, by making sure that the block material is interconnected, firstly providing enough bearing surface for vertically exerted loads, but especially giving the block horizontal stability by connecting the front face and the back face. This will reduce the danger of deformations by insulating material that could be compressed, as is the case in many of the prior art blocks, where the front face and back face are fully separated by at least one slab of insulating material.

Simulations have been run, using TRISCO (version 13w, a finite element software developed by Physibel), whereby the block had a thickness 'd' of 15 cm from the front face to the back face, the block material has a thermal conductivity of 1.7 W/(m·K) and the thermally insulating material has a thermal conductivity of 0.023 W/(m·K). This resulted in a theoretical result of a thermal conductivity for the block as a whole, of 0.094 W/(m·K). This result was retrieved by obtaining a heat transfer coefficient for the block, $U_{eq}$, from TRISCO, and using said $U_{eq}$ in the following calculation:

$$U_{eq} = 0.569\ \text{W/m}^2\text{K}$$

$$R_{eq} = \frac{1}{U_{eq}} = 1.757\ \text{m}^2\text{K/W}$$

$$R_{eq} = \frac{1}{8} + R_{block} + \frac{1}{24}$$

$$R_{block} = R_{eq} - \frac{1}{24} - \frac{1}{8}$$

$$R_{block} = 1.757\ \text{m}^2\text{K/W} - \frac{1}{24} - \frac{1}{8}$$

$$R_{block} = 1.594\ \text{m}^2\text{K/W}$$

$$R_{block} = \frac{d_{block}}{\lambda_{block}}$$

$$\lambda_{block} = \frac{d_{block}}{R_{block}}$$

$$\lambda_{block} = \frac{0.15\ \text{m}}{1.591\ \text{m}^2\text{K/W}}$$

$$\lambda_{block} = 0.094\ \text{W/mK}$$

For the following examples, a $U_{eq}$ for the examples was obtained from TRISCO and used in the formulas above to supply a thermal conductivity for the entire block in each example. Note that similar values for thermal conductivity were obtained for the following embodiments as well.

Example 3

Improved Configuration 1

Figure 3:
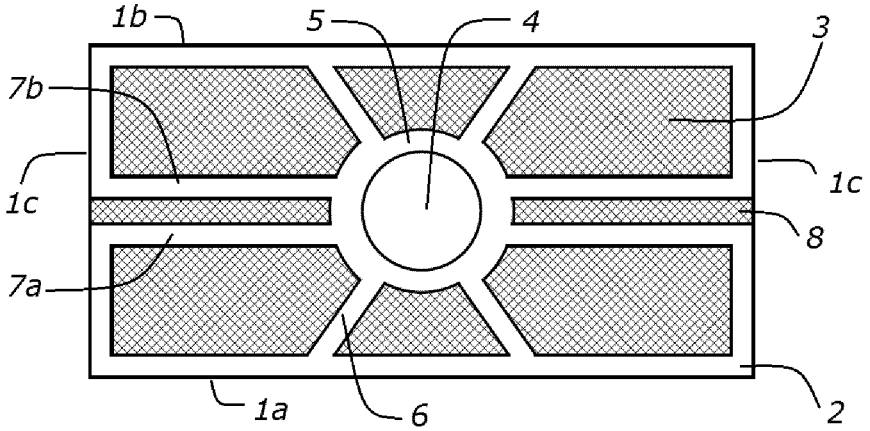

In an improved configuration according to FIG. 3, four crosslinks (6) are present, two of the crosslinks (6) connect the front face (1*a*) to the walls (5), and two of the crosslinks (6) connect the back face (1*b*) to the walls (5). This configuration provides even greater resistant to horizontal forces and pressure, but does offer a slightly lower total thermal resistance, which remains by far better than most of the currently used blocks that are adapted for similar purposes. In the embodiment of FIG. 3, the walls (5) around the through-hole (4) are not of a uniform thickness and are thicker towards the left and right side in the figure, however, this is only an embodiment and does in no way limit the embodiment to such a configuration. The crosslinks (6) are placed under an angle with the front face (1*a*) (or with the back face (1*b*)) of about 55° in this embodiment, as can be seen in FIG. 3. However, other angles are possible for this configuration, such as 5°, 10°, 15°, 20°, 25°, 30°, 35°, 40°, 45°, 50°, 60°, 65°, 70°, 75°, 80°, 85° and other values in between, as shown in a later example. A lower value for this angle is still preferable, as this establishes a longer path through the crosslinks (6). The shortest thermal path in this embodiment goes through the crosslinks (6), and as such, lengthens this path less than the previous embodiment, however still providing a significant improvement in thermal resistance than the embodiments of the prior art.

Simulations have been run, using TRISCO, whereby the block had a thickness 'd' of 15 cm, the block material has a thermal conductivity of 1.7 W/(m·K) and the thermally insulating material has a thermal conductivity of 0.023 W/(m·K). This resulted in a theoretical result of a thermal conductivity for the block as a whole, of 0.201 W/(m·K), a result that could be improved (lowered), as can be seen in the next example.

Example 4

Improved Configuration 2

Figure 4:
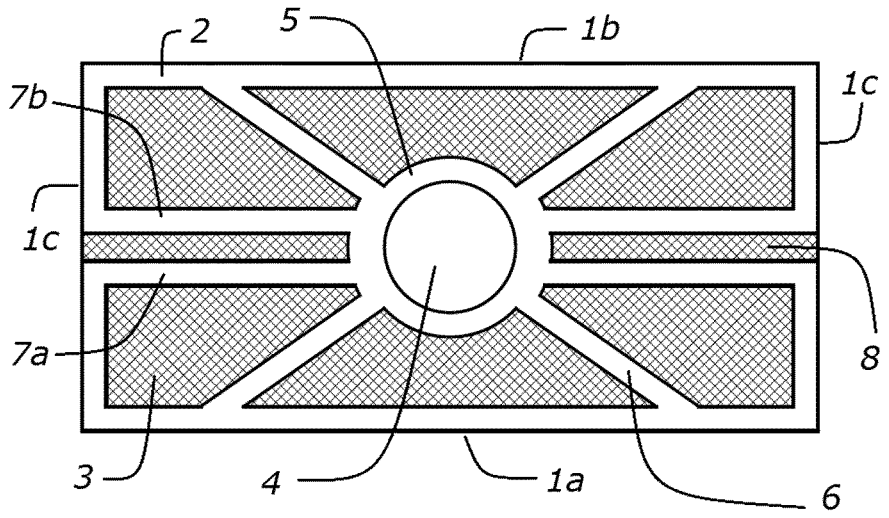

In an alternative configuration according to FIG. 4, crosslinks (6) are again present, four crosslinks (6) are present, two of the crosslinks (6) connect the front face (1*a*) to the walls (5), and two of the crosslinks (6) connect the back face (1*b*) to the walls (5), as in example 3. However, the crosslinks (6) are this time placed under a lower angle with respect to the front face (1*a*). It is clear that the shortest path from the front face (1*a*) to the back face (1*b*) through the block material (2) extends through the crosslinks (6), which are significantly longer than in the previous example and as such, provide a greater thermal resistance for this path. In the FIG. 4, the angle is about 35°, but it is to be understood that the figures are only possible configurations, and that other angles, both higher and lower (preferably lower due to the longer path length), are also possible.

Again, in the embodiment of FIG. 4, the walls (5) around the through-hole (4) are not of a uniform thickness and are thicker towards the left and right side in the figure, however, this is only an embodiment and does in no way limit the embodiment to such a configuration.

Simulations have been run, using TRISCO, whereby the block had a thickness 'd' of 15 cm, the block material has a thermal conductivity of 1.7 W/(m·K) and the thermally insulating material has a thermal conductivity of 0.023 W/(m·K). This resulted in a theoretical result of a thermal conductivity for the block as a whole, of 0.185 W/(m·K)

Example 5

Improved Configuration 3

Figure 5:
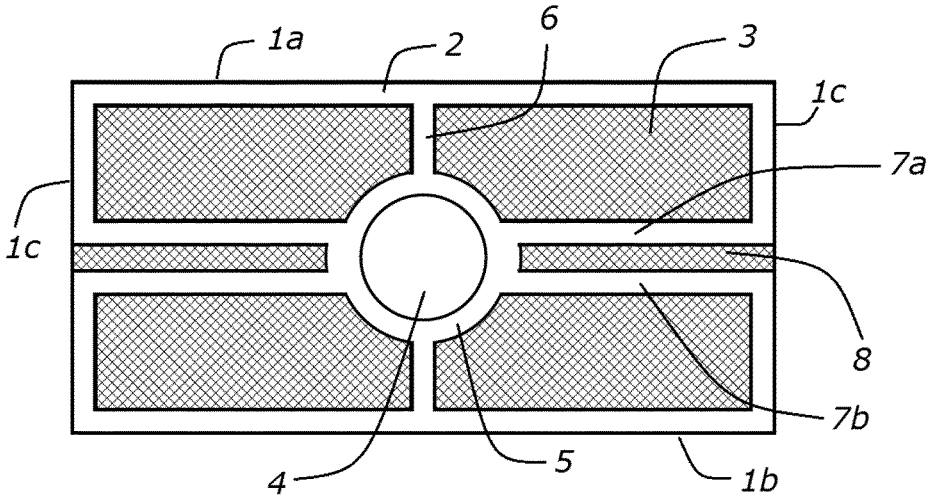

In an alternative improved configuration, a single crosslink (6) connects the front face (1*a*) to the walls (5) and a single crosslink (6) connects the back face (1*b*) to the walls (5), as can be seen in FIG. 5. While the straight connection between the front face (1*a*) and the walls (5), and the back face (1*b*) and the walls (5) provides more resistance against horizontal forces on the front face (1*a*) or the back face (1*b*) by the straight connection, it does however also reduce the shortest path length of the previous examples 2, 3 and 4. Nonetheless, the embodiment as shown still surpasses prior art inventions as the shortest path length is lengthened and, as opposed to most prior art inventions where the shortest path length is along the two side faces (1*c*), there is only one such a path, thus severely reducing the impact of this path.

Furthermore, in the case that a through-hole (4) with walls (5) is present, it is to be understood that a range of configurations are possible with 1, 2, 3, 4 or more crosslinks (6) connecting the front face (1*a*) to the walls 5), whereby the crosslinks (6) can be angulated with respect to the front face (1*a*) under an angle of 5°, 10°, 15°, 20°, 25°, 30°, 35°, 40°, 45°, 50°, 60°, 65°, 70°, 75°, 80°, 85° and other values in between. Also, it is to be understood that a range of configurations are possible with 1, 2, 3, 4 or more crosslinks (6) connecting the back face (1*b*) to the walls (5), whereby the crosslinks (6) can be angulated with respect to the back face (1*b*) under an angle of 5°, 10°, 15°, 20°, 25°, 30°, 35°, 40°, 45°, 50°, 60°, 65°, 70°, 75°, 80°, 85° and other values in between.

Simulations have been run, using TRISCO, whereby the block had a thickness 'd' of 15 cm, the block material has a thermal conductivity of 1.7 W/(m·K) and the thermally insulating material has a thermal conductivity of 0.023 W/(m·K). This resulted in a theoretical result of a thermal conductivity for the block as a whole, of 0.162 W/(m·K).

Example 6

Improved Configuration 4

Figure 6:
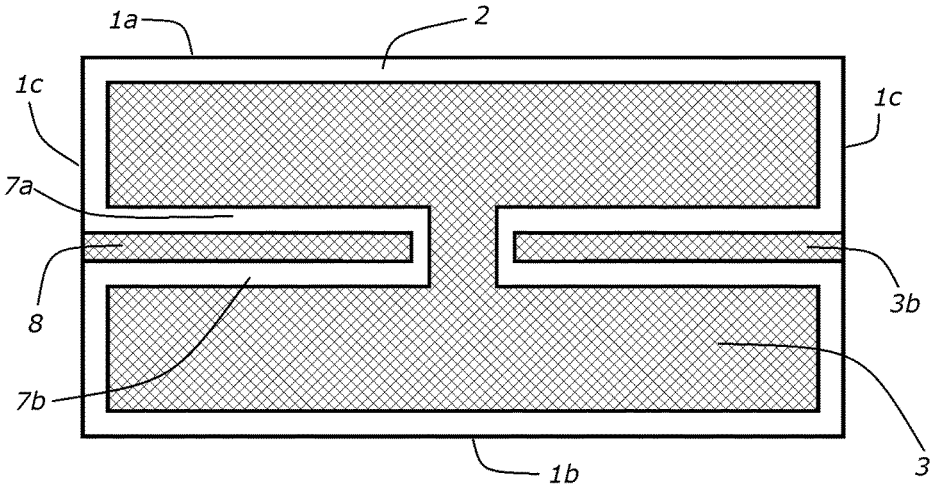

In an alternative improved configuration, a single cavity (central hatched area) is provided in the block body, as can be seen for instance in FIG. 6. No through-hole is present in this embodiment, however interstices (8) are present in the side faces (1*c*), dividing the side faces (1*c*) in two separate sections, separated by thermally insulating material (3*b*), preferably the same as the thermally insulating material (3) in the cavity. The interstices (8) extend inwards into the block body with a certain incision depth which can vary according to wishes, for instance, however, a high incision depth is preferable as it both lengthens the shortest path length through the block material (2), and gives the block more structural strength by enlarging the supporting base for vertical forces, as well as reinforcing the structure horizontally. It is to be noted that the distance to which the interstices penetrate the side faces can differ depending on the requirements of a certain practical situation. The distance between the block material around the thermally insulating material in the two interstices, can for instance be between 0.5 cm and 10 cm, or between 1.0 cm and 8 cm, or between 1.5 cm and 6 cm. Values therein between are of course possible, depending on the situation. By having a shorter distance in between, the block would comprise slightly more block material than usual, but would still have excellent insulating properties (both lateral from side to side as transversal from front to back), while using minimal block material, thus being lighter and cheaper to manufacture.

Simulations have been run for the block of FIG. 6, using TRISCO, whereby the block had a thickness of 15 cm, the block material has a thermal conductivity of 1.7 W/(m·K) and the thermally insulating material has a thermal conductivity of 0.023 W/(m·K). This resulted in a theoretical result of a thermal conductivity for the block as a whole, of 0.089 W/(m·K). Depending on other dimensions of the block material and/or insulating material, thermal conductivities have been achieved of 0.075 W/(m·K), with 74% of the block volume being insulating material, and 0.082 W/(m·K) with 69% of the block volume being insulating material.

Example 7

Improved Configuration 4

Figure 7:
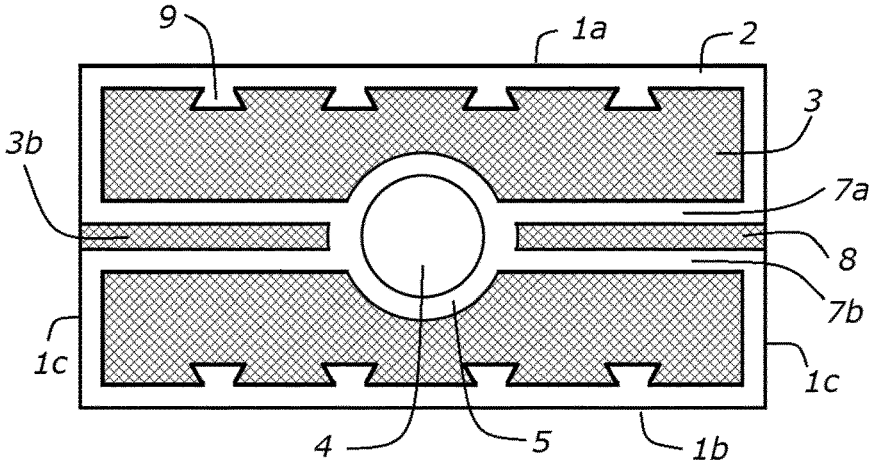

In a further improved configuration on example 6, jagged extensions (9) are present, as can be seen in FIG. 7, between the block material (2) of the front face (1*a*) and the back face (1*b*), and the thermally insulating material (3) to provide more strength. These extensions (9) can also be present on the block material (2) of the side faces (1*c*) and the thermally insulating material (3), or on the block material (2) of the walls (5) and the thermally insulating material (3), or on the block material (2) of the connections (7*a*, 7*b*) and the thermally insulating material (3). Note that the extensions can be present in other examples as well.

In example 6 and 7, crosslinks can be added, for instance connecting the front face and/or the back face to the block material that borders the interstices, or even connecting the front face (1*a*) to the back face (1*b*), for instance under an angle thus lengthening the shortest path through the block material (2).

Simulations have been run, using TRISCO, whereby the block had a thickness 'd' of 15 cm, the block material has a thermal conductivity of 1.7 W/(m·K) and the thermally insulating material has a thermal conductivity of 0.023 W/(m·K). This resulted in a theoretical result of a thermal conductivity for the block as a whole, of 0.100 W/(m·K).

Example 8

Improved Configuration 5

Figure 8:
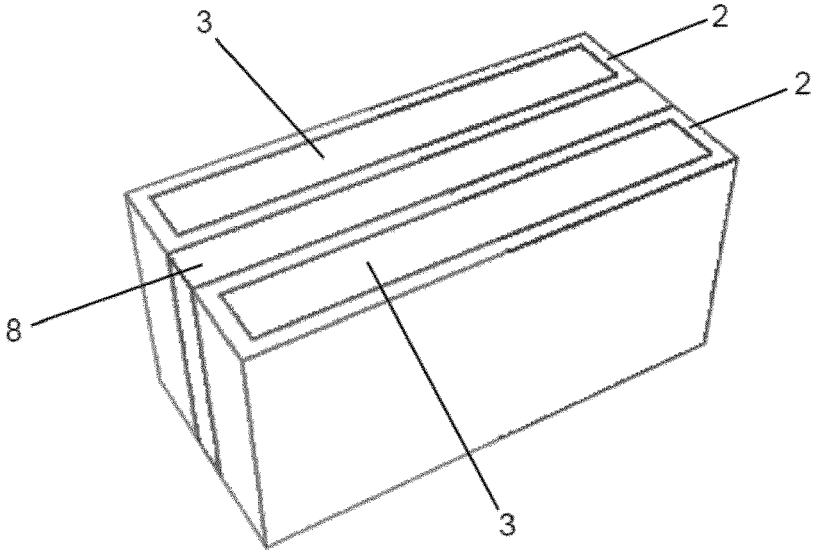

In a possible embodiment according to FIG. 8, the block comprises two block sections which each have a cross-section which comprises a rectangular structure of block material, whereby the interior of the rectangular structure comprises insulating material. The two block sections are connected by a slab of insulating material (8), as can be seen in the FIG. 8. This can also be seen as the interstices of the block of FIG. 6 extending across the entire block and combining with each other. Again, dimensions can vary depending on the requirements for the block in strength and insulation, and indications for the dimensions can be found throughout this document. For instance, the thickness of the slab of insulating material can be between 10% to 40% of the entire breadth of the block. In general about 60% to 75% of the block volume may comprise insulating material, depending on the chosen dimensions of the design, while allowing a thermal conductivity of about 0.059 W/(m·K).

Example 9

Improved Configuration 6

Figure 9:
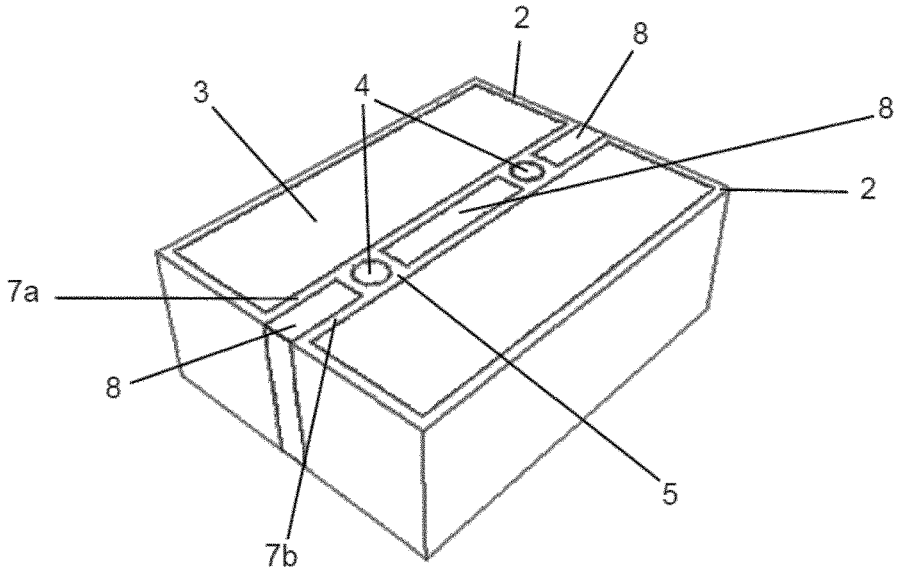
Figure 10:
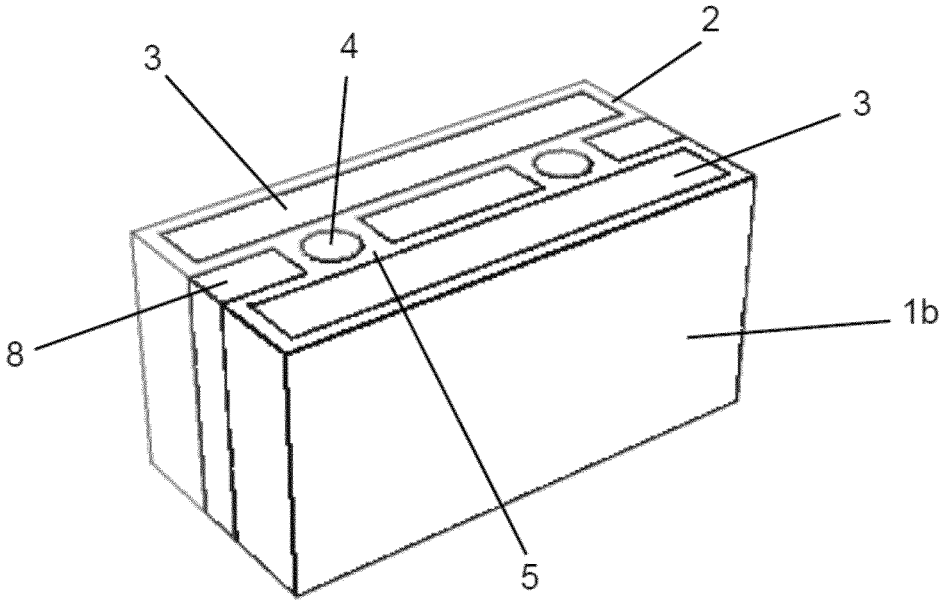
Figure 11:
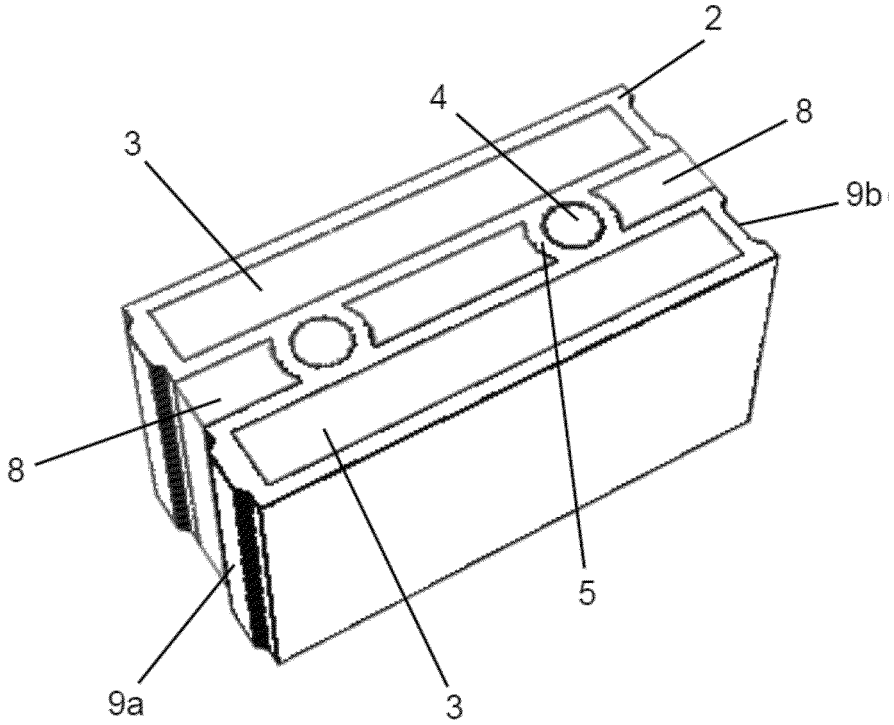

In a possible embodiment according to FIGS. 9, 10 and 11, the block is substantially similar to that of example 8, whereby however, the two separate block sections are connected by two sets of walls (5) for through-holes (4) for rebar. Again, dimensions can vary depending on the situation, and indications for the dimensions can be found throughout this document. Note that in FIG. 11, the block furthermore comprises matching grooves (9*b*) and protuberances (9*a*) on the side faces to easily and correctly align blocks, and further strengthening the interlocking of neighboring blocks. These designs typically have a percentage of at least 60% up to 85% of the total volume of the block being insulating material, with respective thermal conductivity values of 0.072W/(m·K), 0.065 W/(m·K), 0.069 W/(m·K), again depending on chosen dimensions.

Example 10

Improved Configuration 7

Figure 12:
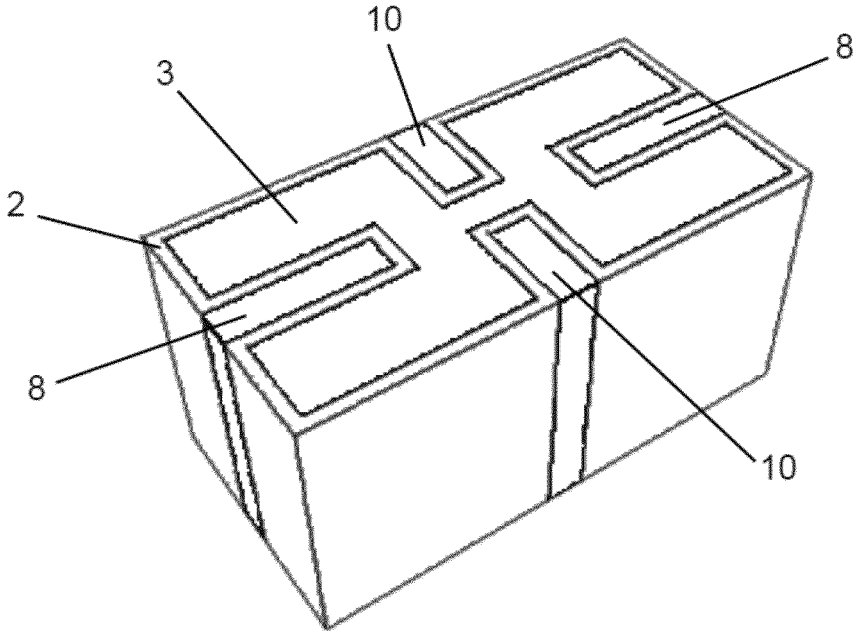

In a possible embodiment according to FIG. 12 similar to that of FIG. 6, further interstices (10) comprising thermally insulating material are present in the front face and the back face as well, extending inwardly towards the center of the block, and preferably extend over the entire height of the block. As can be seen, this lengthens the straight path along the length of the brick, impeding such a lateral heat transfer. Furthermore, while still minimizing the amount of block material used in the block, the structure offers excellent characteristics in strength and resistance to vertical pressure and forces (perpendicular to the top/bottom face). The block according to the figure, consists for 76% of the block volume of insulating material, and provides a thermal conductivity of about 0.091 W/(m·K). Furthermore, a 'lateral' thermal conductivity has been checked for this block (from side face to side face), and resulted in 0.179 W/(m·K).

Example 11

Improved Configuration 8

Figure 13:
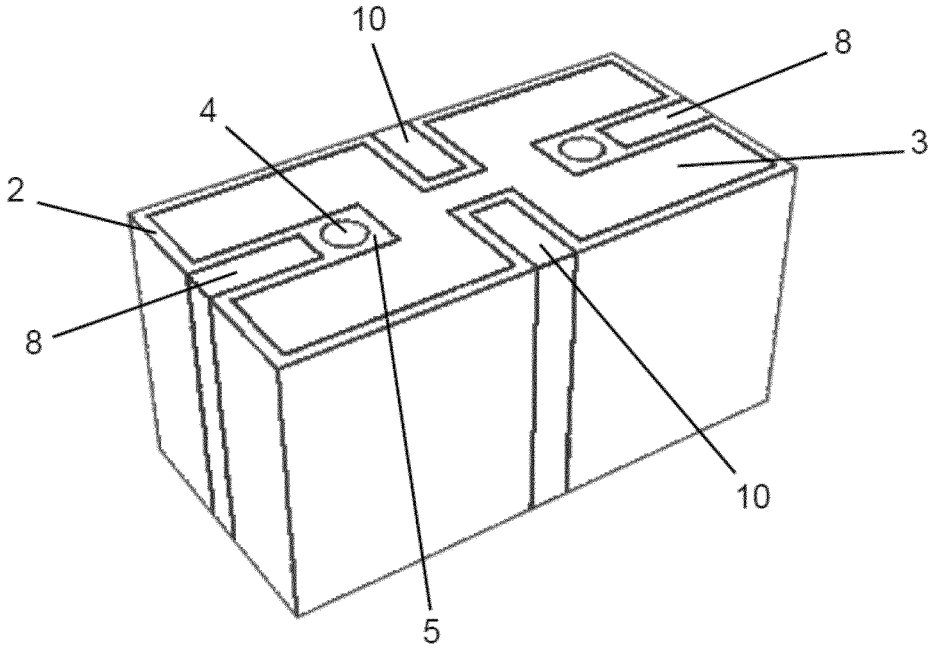

In a possible embodiment according to FIG. 13, similar to that of example 10, the interstices (10) in the side faces each terminate in a block material column extending over the height of the block. Each of the block material columns serve as the walls (5) for a through-hole (4) in said column, as can be seen in the FIG. 13. As is the case for the previous embodiment, this design allows the block to be able to handle very high loads and pressures, while the amount of block material is again kept very low (typically below 30%, even below 25% is possible for the former embodiment). By impeding heat transfer not only transversally (from front to back face) but also laterally (side to side face), a structure built with these blocks will not allow the heat to easily flow laterally in the wall (or other structure) to a thermal weak spot, thus negating part of the advantages of the transversal insulating properties of the block. This further characteristic is also present in some of the other blocks provided by the invention. The block according to the figure, consists for 74% of the block volume of insulating material, and provides a thermal conductivity of about 0.100 W/(m·K). The 'lateral' thermal conductivity has been checked for this block, and this produced 0.179 W/(m·K).

Example 12

Improved Configuration 9

Figure 14:
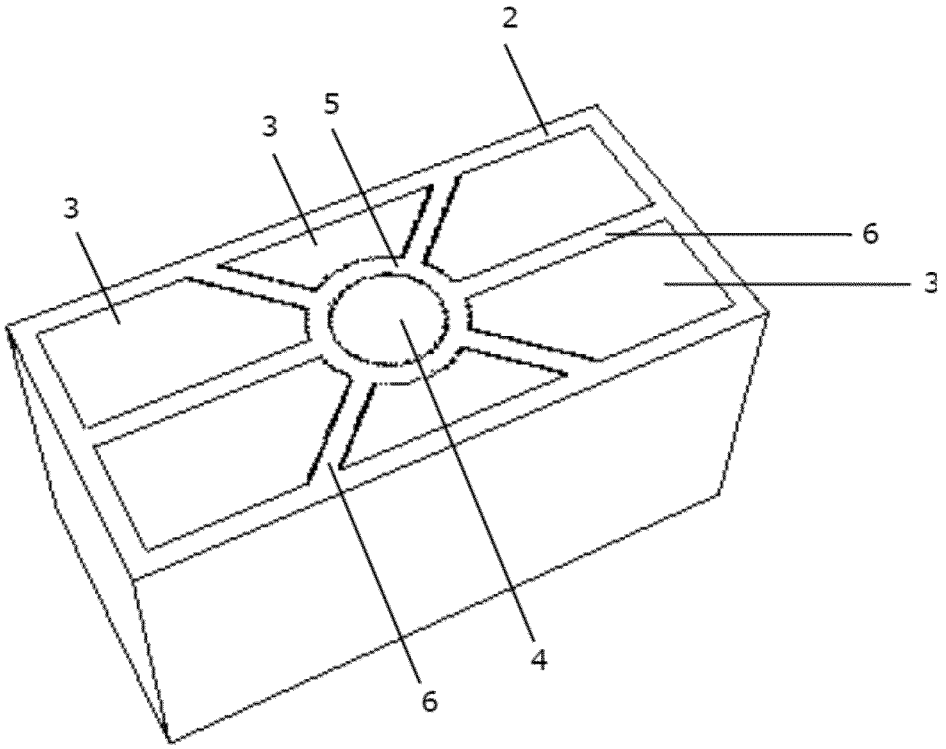
Figure 15:
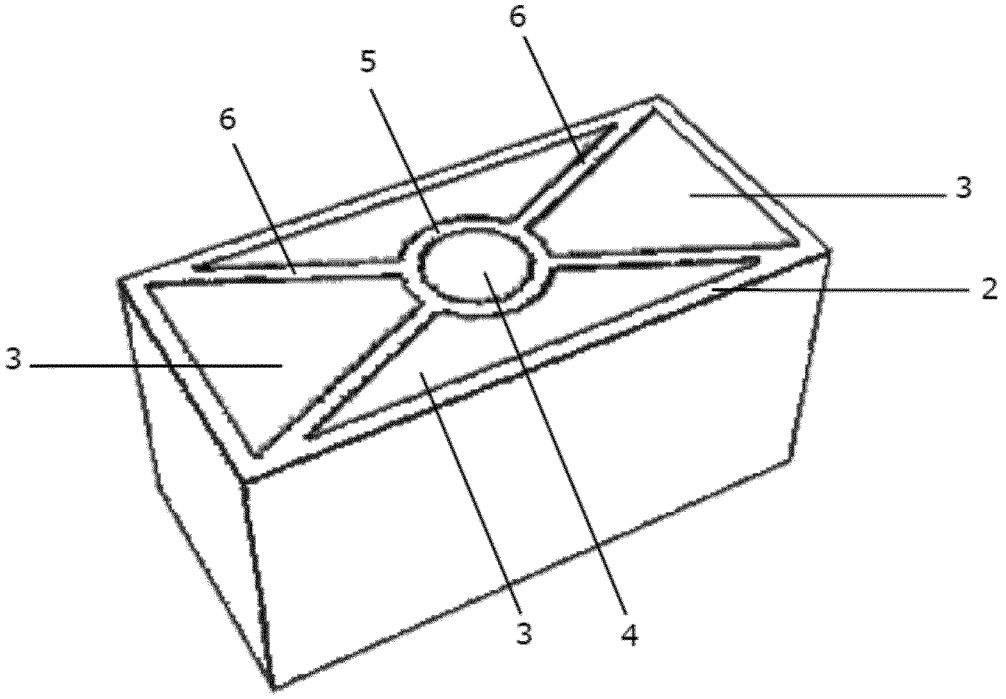
Figure 16:
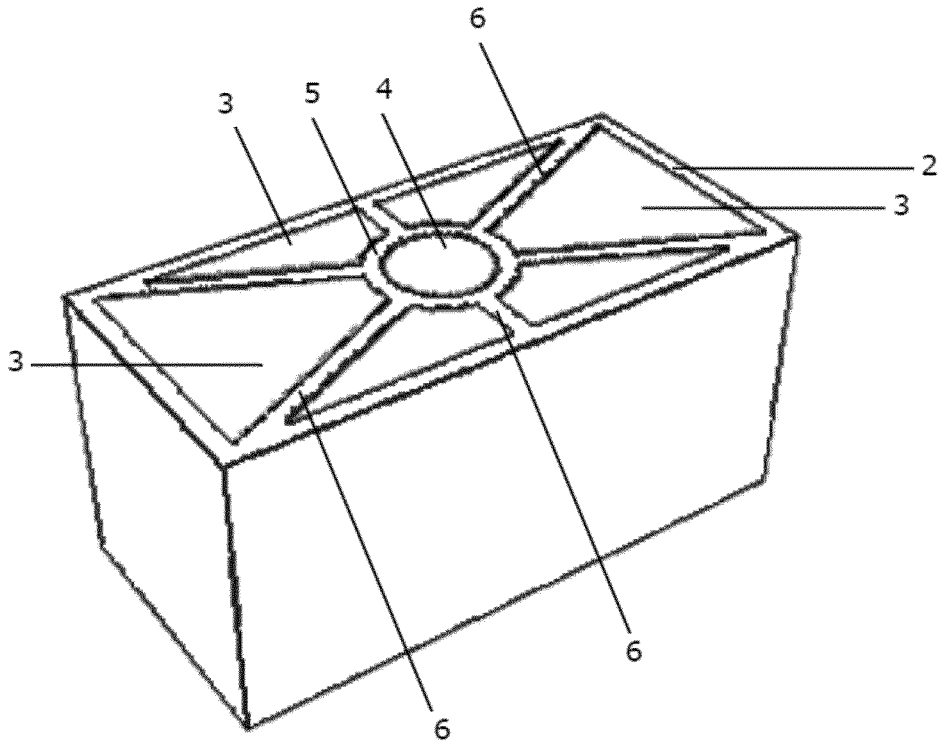

The embodiments of FIGS. 14, 15 and 16 show a design for an insulating block with a single through-hole (4) for rebar, with a variable number of crosslinks (6) either connecting the walls (5) around the through-hole with the front, back or side faces (and possibly both side and front or back face in the case of FIG. 16), and thus creating a number of cavities (3) with a substantial volume that is filled with the insulating materials (3), (substantial relative to the volume of the convex hull of the block, at least 60%, even 63%, 65% and 64%), thus creating blocks with excellent strength and insulating characteristics, both from front to back as well as from side to side.

The invention claimed is:

1. An improved insulating block comprising:

a block body;

whereby the block body is made of a block material; and comprises a top face, a bottom face, a front face, a back face, two side faces and at least one cavity;

whereby the back face is parallel to the front face;

whereby said cavity extends from the top face to the bottom face and comprises a first thermally insulating material;

whereby the front face and the back face are both substantially made of the block material, and are connected to each other by the block material;

whereby any shortest path from the front face to the back face through only the block material is longer, than the front face is distanced from the back face for providing thermal insulation between the front face and the back face and for increasing strength between the bottom face and the top face;

wherein the block material represents less than 42% of the volume of a convex hull of the block body, and whereby the block body has a material cross section parallel to the bottom face that is substantially constant over the entire height of the block body.

2. The improved insulating block according to claim 1, whereby the block comprises at least one, through-hole for a rebar, extending centrally from the top face to the bottom face, and whereby walls surrounding the through-hole have a thickness of at least 0.5 cm and at most 2.0 cm, whereby said walls are substantially of the block material, wherein the through-hole is dimensioned to fixedly receive a rebar of a predetermined diameter, whereby no straight path between the front face to the back face is provided through only the block material and the through-hole for the rebar.

3. The improved insulating block according to claim 2, whereby the block comprises two of said through-holes for a rebar, wherein a first of the through-holes is only connected to the front face and the back face of the block by the block material via one or more of the side faces.

4. The improved insulating block according to claim 2, whereby the walls surrounding the through-hole are connected to the front face or the back face by one or more crosslinks made of the block material, whereby the crosslinks extend from the walls to the front face or to the back face, and whereby the crosslinks extend from the top face to the bottom face.

5. The improved insulating block according to claim 1, whereby the block material comprises two through-holes for rebar in a plane parallel to the front face of the block body, whereby the through hole has surrounding walls which are substantially of the block material, whereby the two through-holes are distanced from each other over a distance equal to about half of the distance between the two side faces, whereby a first of the two through-holes is distanced from the first side face over a distance equal to about a quarter of the distance between the two side faces and whereby a second of the two through-holes is distanced from the second side face over a distance equal to about a quarter of the distance between the two side faces.

6. The improved insulating block according to claim 2, whereby the walls surrounding the at least one through-hole for rebar are connected to the front face and to the back face, and whereby imaginary lines perpendicular to the front face or the back face and intersecting the walls surrounding the at least one through-hole, intersect at least one of a thermally insulating materials.

7. The improved insulating block according to claim 2, whereby imaginary lines perpendicular to the front face or the back face and intersecting the walls surrounding the at least one through-hole, intersect at least one of a thermally insulating materials in a imaginary section of the line that is positioned between the walls surrounding the through-hole and the front face, and whereby the imaginary lines intersect at least one of the first thermally insulating materials in a imaginary section of the line between the walls surrounding the through-hole and the back face.

8. The improved insulating block according to claim 1, whereby the insulating block comprises a first through-hole for rebar and a second through-hole for rebar, extending centrally from the top face to the bottom face, whereby the through holes have surrounding walls of the block material, and whereby the first through-hole of the insulating block is designed to align with a first or a second through-hole of a second insulating block, which second insulating block is substantially identical to the improved insulating block, when the insulating block is positioned staggered with respect to the second insulating block, and whereby the second through-hole of the insulating block is designed to align with first or a second through-hole of a third insulating block, which third insulating block is substantially identical to the improved insulating block, when the insulating block is positioned staggered with respect to the third insulating block; and whereby paths perpendicular to the front face of the insulating block and intersecting the walls of the first or the second through-hole of the insulating block intersect at least one of a thermally insulating materials of the insulating block.

9. The improved insulating block according to claim 1, whereby the two side faces are oppositely positioned and substantially made of the block material, whereby the side faces connect the front face to the back face and connect the bottom face to the top face, whereby each of the side faces is divided in at least two separate imaginary sections of the block material, whereby the imaginary sections of each of the side faces are separated by interstices comprising a second thermally insulating material, whereby the interstices extend from the top face to the bottom face, so that a line through the front face and perpendicular to the front face always intersects with the first thermally insulating material and/or the second thermally insulating material.

10. The improved insulating block according to claim 9, whereby the separate sections of the first side face are connected by a first indented arch of the block material, and whereby the separate sections of the second side face are connected by a second indented arch of the block material, whereby the first and second arches of the block material each comprise two inwardly extending paths of the block material which are connected by a bridge of the block material, and whereby the arches each define one of the interstices, preferably, whereby the inwardly extending paths each extend inwardly over at least 10% of the length of the block.

11. The improved insulating block according to claim 9, whereby the block comprises at least one through-hole for a rebar, extending centrally from the top face to the bottom face, and whereby walls surrounding the through-hole have a thickness of at least 0.5 cm and at most 2.0 cm, whereby said walls are substantially of the block material, wherein the through-hole is dimensioned to fixedly receive a rebar of a predetermined diameter, whereby no straight path between the front face to the back face is provided through only the block material and the through-hole for the rebar, whereby the thermally insulating material in the interstices extends from the side faces to the walls surrounding the through-hole, and whereby the interstices are oriented perpendicularly to the side faces.

12. The improved insulating block according to claim 1, whereby the block has a first plane of symmetry equidistant from the front face and the back face, and a second plane of symmetry equidistant from the two side faces.

13. The improved insulating block according to claim 1, whereby the block has a length, a depth and a height, whereby the length is comprised between 15 cm and 75 cm, whereby the depth is comprised between 10 cm and 35 cm, and whereby the height is comprised between 10 cm and 20 cm, and whereby the block material of the front face, the back face and the side faces has a thickness of at least 0.5 cm.

14. The improved insulating block according to claim 1, whereby the block comprises a front inner wall and a back inner wall, the front face being connected to the front inner wall via the side faces whereby said front face and said front inner wall are separated by the first insulating material, and the back face being connected to the back inner wall via the side faces whereby said back face and said back inner wall are separated by a second insulating material, whereby said front inner wall and said back inner wall are only connected through the block material by a first set of through-hole walls for a first through-hole for rebar and by a second set of though-hole walls for a second through-hole for rebar, whereby the first and second through-hole are distanced from each other over a distance equal to about half of the distance between the two side faces and are further separated from each other by a third insulating material.

15. A thermally insulating wall comprising a plurality of insulating blocks according to claim 1, whereby said blocks are placed in staggered layers and wherein said wall comprises at least one rebar, which extends through through-holes of at least two of said blocks.

16. A method for manufacturing improved thermally insulating blocks according to claim 1, comprising the following steps:

a. providing a formwork shaped to encompass the finished block;
b. placing one or more pieces of preformed thermally insulating material in the formwork, whereby said pieces are separated from each other and extend from the bottom to the top of the formwork;
c. providing the flowing block material in the formwork, whereby the flowing block material fills the formwork and fills spaces between and around the insulating materials in the formwork;

wherein the thermally insulating material and the formwork is placed in a manner that any shortest path from the front face to the back face through the block material is longer than the front face is distanced from the back face.

17. A method for manufacturing improved thermally insulating blocks according to claim 1, comprising the following steps:

a. providing a formwork shaped to encompass the finished block, said formwork comprising one or more extrusions which extend upwards in the formwork from the bottom to the top of the formwork;
b. providing the flowing block material in the formwork, whereby the flowing block material fills the formwork and fills spaces between and around the extrusions in the formwork;
c. allowing the block material to turn solid;
d. removing the solidified block from the formwork;
e. providing the thermally insulating material in the cavity in the solidified block, said cavity being formed by the extrusions of the formwork;

wherein the extrusions are provided in a manner such that after filling the formwork with the block material, any shortest path from the front face to the back face through the block material is longer than the front face is distanced from the back face.

18. Use of an improved insulating block, comprising a block body; whereby the block body is made of a block material; and comprises a top face, a bottom face, a front face, a back face, two side faces and at least one cavity-whereby the back face is parallel to the front face; whereby said cavity extends from the top face to the bottom face and comprises a first thermally insulating material; whereby the front face and the back face are both substantially made of the block material, and are connected to each other by the block material; whereby any shortest path from the front face to the back face through only the block material is longer, than the front face is distanced from the back face for providing thermal insulation between the front face and the back face and for increasing strength between the bottom face and the top face; wherein the block material represents less than 42% of the volume of a convex hull of the block body, and whereby the block body has a material cross section parallel to the bottom face that is substantially constant over the entire height of the block body, as at least a first layer of a wall in order to provide a reduced thermal conductivity for the wall as a whole.

19. A thermally insulating wall comprising a plurality of insulating blocks, wherein each of the insulating blocks comprises a block body; whereby the block body is made of a block material; and comprises a top face, a bottom face, a front face, a back face, two side faces and at least one cavity; whereby the back face is parallel to the front face; whereby said cavity extends from the top face to the bottom face and comprises a first thermally insulating material; whereby the front face and the back face are both substantially made of the block material, and are connected to each other by the block material; whereby any shortest path from the front face to the back face through only the block material is longer than the front face is distanced from the back face for providing thermal insulation between the front face and the back face and for increasing strength between the bottom face and the top face; wherein the block material represents less than 42% of the volume of a convex hull of the block body, and whereby the block body has a material cross section parallel to the bottom face that is substantially constant over the entire height of the block body, whereby said blocks are placed in staggered layers.

* * * * *